US012520986B2

(12) United States Patent
Büsing et al.

(10) Patent No.: US 12,520,986 B2
(45) Date of Patent: Jan. 13, 2026

(54) DISHWASHER

(71) Applicant: SAMSUNG ELECTRONICS CO., LTD., Suwon-si (KR)

(72) Inventors: Johannes Büsing, Suwon-si (KR); Jisun Yang, Suwon-si (KR); Sungjin Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 243 days.

(21) Appl. No.: 18/140,957

(22) Filed: Apr. 28, 2023

(65) Prior Publication Data

US 2024/0000288 A1 Jan. 4, 2024

Related U.S. Application Data

(63) Continuation of application No. PCT/KR2023/004695, filed on Apr. 7, 2023.

(30) Foreign Application Priority Data

Jun. 30, 2022 (KR) ..... 10-2022-0080951

(51) Int. Cl.
*A47L 15/42* (2006.01)

(52) U.S. Cl.
CPC ..... *A47L 15/4223* (2013.01); *A47L 15/4225* (2013.01)

(58) Field of Classification Search
CPC ..... A47L 15/4204; A47L 15/4214; A47L 15/4219; A47L 15/4221; A47L 15/4223; A47L 15/4225; A47L 15/4246
See application file for complete search history.

(56) References Cited

U.S. PATENT DOCUMENTS 8,714,167 B2 5/2014 Yoon et al.
9,119,519 B2 9/2015 Plum et al.
(Continued)

FOREIGN PATENT DOCUMENTS

CN 203369878 U 1/2014
CN 204562055 U 8/2015
(Continued)

OTHER PUBLICATIONS

Intellectual Property dated Jul. 18, 2023 issued in PCT Application No. PCT/KR2023-004695.
(Continued)

*Primary Examiner* — David G Cormier
(74) *Attorney, Agent, or Firm* — STAAS & HALSEY LLP

(57) ABSTRACT

A dishwasher may include: a tub having a washing chamber formed therein, the tub including an opened bottom and an opening flange are formed in the opened bottom; a distribution device to distribute washing water sprayed into the washing chamber; a sump housing couplable to the opening flange of the tub, the sump housing including a distribution chamber to accomodate at least a portion of the distribution device; a support plate disposed on the opening flange of the tub, the support plate including a plate opening corresponding to the distribution chamber; and a distribution cover to be insertable into the plate opening and to be rotated, and coupled to the support plate while pressing the support plate, to cover an upper portion of the distribution chamber.

15 Claims, 20 Drawing Sheets

(56) References Cited

U.S. PATENT DOCUMENTS

| | | | | |
|---|---|---|---|---|
| 9,220,393 | B2 | 12/2015 | Becker et al. | |
| 11,000,177 | B2 | 5/2021 | Mason et al. | |
| 11,357,383 | B2 | 6/2022 | Shin et al. | |
| 11,564,553 | B2 | 1/2023 | Busing et al. | |
| 2006/0060223 | A1* | 3/2006 | Choi | A47L 15/4246 134/104.2 |
| 2015/0000714 | A1 | 1/2015 | Yoo et al. | |
| 2015/0182096 | A1 | 7/2015 | Kim | |
| 2017/0027406 | A1* | 2/2017 | Durham | A47L 15/4221 |
| 2019/0200840 | A1* | 7/2019 | Koepke | A47L 15/4221 |
| 2020/0008644 | A1 | 1/2020 | Ju et al. | |
| 2020/0022557 | A1 | 1/2020 | Rappette et al. | |
| 2020/0397214 | A1* | 12/2020 | Shin | A47L 15/4217 |

FOREIGN PATENT DOCUMENTS

| | | | |
|---|---|---|---|
| CN | 104688157 | B | 9/2017 |
| EP | 2 906 099 | B1 | 11/2016 |
| KR | 10-2015-0001592 | | 1/2015 |
| KR | 10-2015-0080358 | | 7/2015 |
| KR | 10-1629053 | | 6/2016 |
| KR | 10-1633932 | | 6/2016 |
| KR | 10-2019-0096165 | | 8/2019 |
| KR | 10-2021-0057424 | | 5/2021 |

OTHER PUBLICATIONS

Written Opinion dated Jul. 18, 2023 issued in PCT Application No. PCT/KR2023-004695.

Extended European Search Report dated May 21, 2025 for European Application No. 23831681.4, 10 pages.

* cited by examiner

DISHWASHER

CROSS-REFERENCE TO RELATED APPLICATION

This application is a continuation application, filed under 35 U.S.C. § 111(a), of International Application PCT/KR2023/004695 filed Apr. 7, 2023, and is based on and claims priority under 35 U.S.C. § 119 to Korean Patent Applications No. 10-2022-0080951, filed on Jun. 30, 2022, in the Korean Intellectual Property Office, the disclosures of which are hereby incorporated by reference in their entireties.

BACKGROUND

Field

The disclosure relates to a dishwasher having an improved structure.

Description of the Related Art

A dishwasher is a device that automatically removes food residues and the like on dishware using detergent and washing water.

The dishwasher may include a tub forming a washing space, a sump collecting washing water, a pump pumping washing water in the sump, and a spraying device injecting washing water into the tub.

In general, when air is introduced into the washing water contained in the sump, the injection pressure of the washing water may be lowered, and air bubbles may burst, causing noise. In order to prevent the noise from occurring, washing water may be sufficiently filled inside the sump. However, the water consumption of the dishwasher may increase.

On the other hand, some components of the dishwasher may be easily separated by the high water pressure inside of the sump. In addition, separation of the components of the dishwasher may cause leak of washing water.

SUMMARY

According to an aspect of the disclosure, there is provided a dishwasher including: a tub having a washing chamber, the tub including an opened bottom and an opening flange are formed in the opened bottom; a distribution device to distribute washing water sprayed into the washing chamber; a sump housing couplable to the opening flange of the tub, the sump housing including a distribution chamber to accommodate at least a portion of the distribution device; a support plate disposed on the opening flange of the tub, the support plate including a plate opening corresponding to the distribution chamber; and a distribution cover to be insertable into the plate opening and to be rotated, and coupled to the support plate while pressing the support plate, to cover an upper portion of the distribution chamber.

The support plate may further include a plate rib protruding toward the opening flange of the tub to press the opening flange of the tub.

In response to the rotating of the distribution cover, the distribution cover may be in contact with the support plate in an upper to lower direction, and the support plate may be in contact with the opening flange of the tub in the upper to lower direction.

The distribution cover may be movable between a first position in which the distribution cover may be inserted into the distribution chamber and a second position in which the distribution cover may be prevented from being separated from the distribution chamber while rotating from the first position.

The distribution cover may further include a cover sidewall corresponding to a sidewall of the distribution chamber, and a guide protrusion protruding from an outer surface of the cover sidewall, and the sidewall of the distribution chamber may further include a guide rail to guide rotation of the guide protrusion.

The guide rail may further include: an accommodation groove to accommodate the guide protrusion when the distribution cover is located in the first position; and a rail groove to extend from the accommodation groove in a rotation direction of the distribution cover to guide the guide protrusion such that the distribution cover rotates from the first position to the second position.

The guide rail may further include a catching portion formed on an upper side of the rail groove and to be caught with the guide protrusion in a state in which the distribution cover may be located in the second position.

The catching portion may press the guide protrusion in a state in which the distribution cover may be located in the second position.

The support plate may further include a plate protrusion protruding downward from the support plate to be disposed adjacent to the catching portion to prevent the guide protrusion of the distribution cover from entering a region between the sump housing and the support plate.

The catching portion may further include a first inclined surface between the accommodation groove and the rail groove and having a shape sloping downward, wherein the plate protrusion may further include a second inclined surface to correspond to the first inclined surface.

The support plate may further include a protrusion protruding upward from the support plate, and the distribution cover may further include a stopper interfering with the protrusion to limit rotation of the distribution cover located in the second position.

The distribution cover may further include a cover sidewall corresponding to a sidewall of the distribution chamber, and a sealing protrusion protruding from an outer surface of the cover sidewall to be in contact with an inner surface of the sidewall of the distribution chamber.

The opening flange of the tub may include: a first bottom wall on which the support plate is placed; a second bottom wall positioned downward of the first bottom wall and forming the opening of the tub; and a connection sidewall connecting the first bottom wall to the second bottom wall and having a shape sloping downward.

The dishwasher may further include a sealing member provided to seal a region between the tub and the sump housing, the sealing member disposed at a lower side of the first bottom wall and to be in contact with an outer surface of the connection sidewall.

The sump housing may further include a water storage chamber divided from the distribution chamber and to store washing water of the tub, wherein the distribution chamber may be formed by a sidewall extending upward of the water storage chamber.

According to an aspect of the disclosure, there is provided a dishwasher including: a tub including a bottom in which an opening and an opening flange are formed; a sump housing coupled to the opening flange at a lower side of the bottom of the tub and including a distribution chamber exposed through the opening; a distribution cover provided to cover the distribution chamber; and a support plate seated on the opening flange, the support plate including a fastening portion coupled to the opening flange and the sump housing at an upper side of the bottom of the tub, and a pressed portion provided to be pressed by the distribution cover.

The distribution cover may be provided to be rotationally coupled to the distribution chamber.

According to rotational coupling of the distribution cover, the distribution cover may press the support plate, and the support plate may press the opening flange.

A guide rail extending along a rotational direction of the distribution cover may be formed on a sidewall of the distribution chamber. A guide protrusion movable along the guide rail may be formed on a sidewall of the distribution cover.

The tub, the sump housing, and the support plate may be screwed together.

Advantageous Effects

According to one aspect of the disclosure, the sump assembly of the dishwasher can have a compact structure.

According to one aspect of the disclosure, the sump assembly of the dishwasher can have an improved assemblability.

According to one aspect of the disclosure, the dishwasher can prevent washing water from leaking while improve washing efficiency.

DETAILED DESCRIPTION

Figure 1:
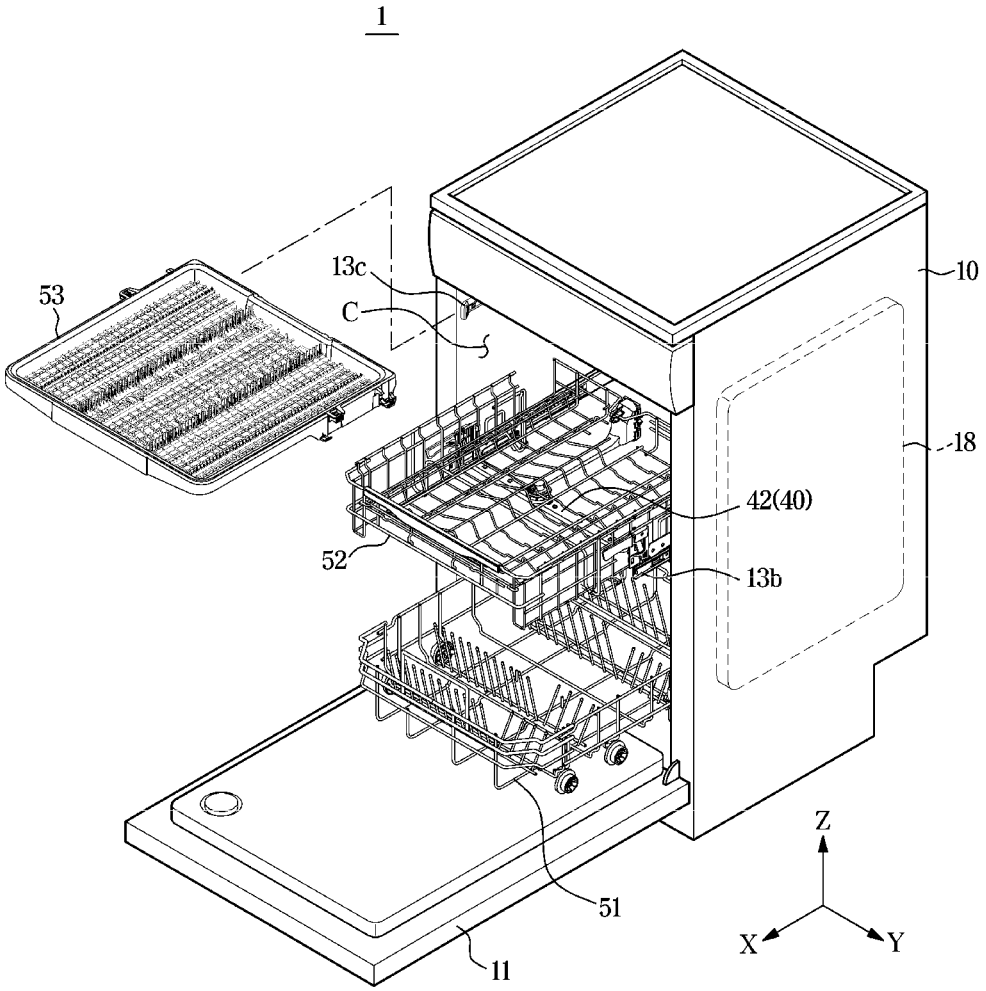
FIG. 1 is a schematic perspective view illustrating a dishwasher according to an embodiment.

Embodiments described in the disclosure and configurations illustrated in the drawings are merely examples of the embodiments of the disclosure, and may be modified in various different ways at the time of filing of the present application to replace the embodiments and drawings of the disclosure.

Also, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

Also, it will be understood that when an element is referred to as being "connected" another element, it may be directly or indirectly connected to the other element. Similarly, it will be understood that when an element is referred to as being "coupled" another element, it may be directly or indirectly coupled to the other element.

Also, throughout the description, when a member is "on" another member, this includes not only when the member is in contact with the other member, but also when there is another member between the two members.

Also, it will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

On the other hand, the terms "up to down direction", "height direction", "vertical direction", "horizontal direction", "upper", "lower", "front to rear direction", etc. used in the following description are defined based on the drawings, and the shape and position of each component are not limited by this term.

Figure 2:
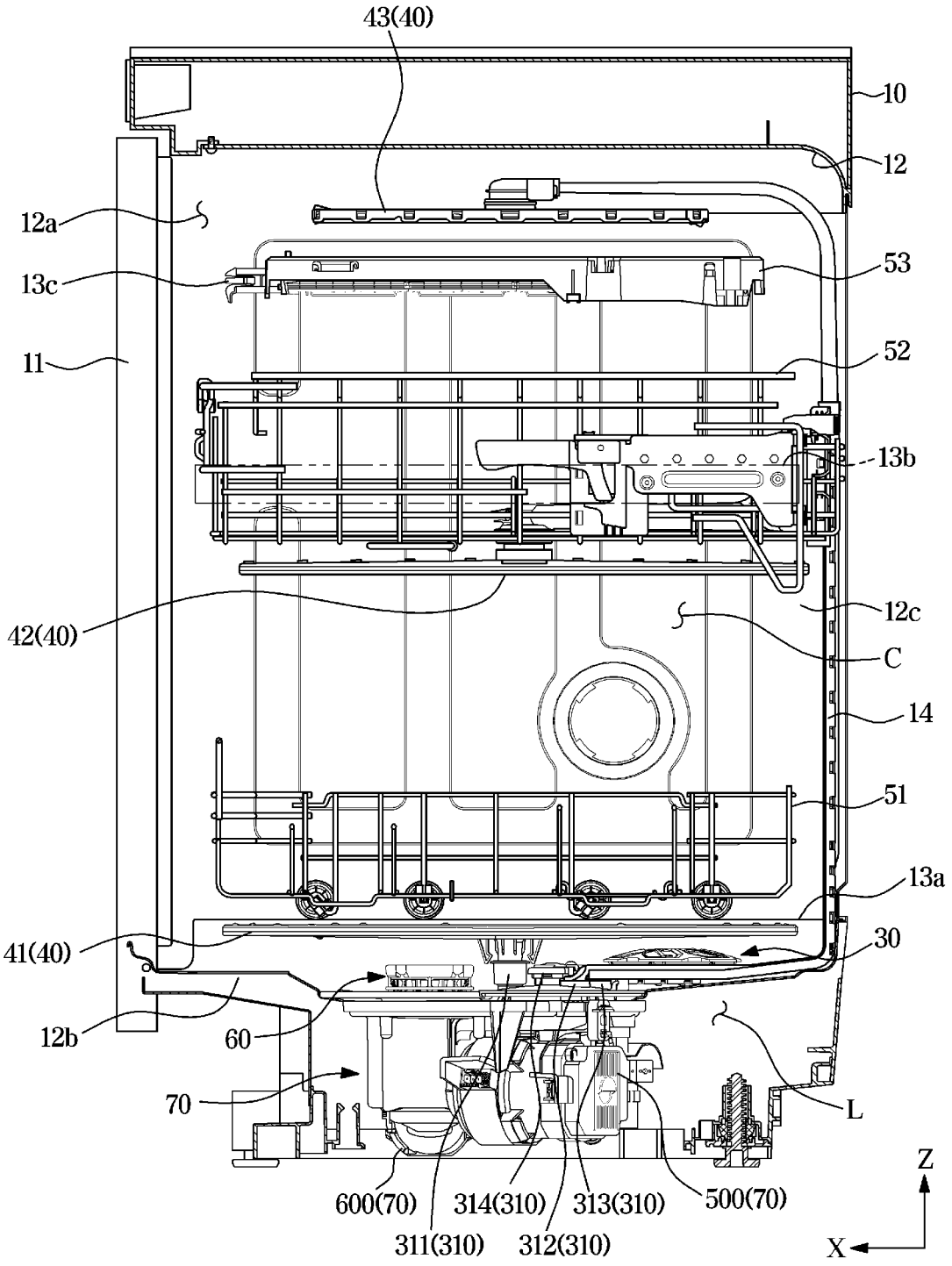
FIG. 2 is a schematic side cross-sectional view illustrating a dishwasher according to one embodiment.

For example, referring to FIGS. 1 and 2, "upper to lower direction", "height direction", and "vertical direction" may refer to the Z direction. The "horizontal direction" may refer to any direction along the X-Y plane. However, the above description is merely illustrative, and is not limited thereto.

Hereinafter, embodiments according to the disclosure will be described in detail with reference to the accompanying drawings.

One aspect of the disclosure provides a dishwasher including a sump assembly with an improved structure.

One aspect of the disclosure provides a dishwasher including a sump assembly having a compact structure.

One aspect of the disclosure provides a dishwasher having a reduced water usage.

One aspect of the disclosure provides a dishwasher capable of withstanding high water pressure.

FIG. 1 is a schematic perspective view illustrating a dishwasher according to an embodiment. FIG. 2 is a schematic side cross-sectional view illustrating a dishwasher according to one embodiment.

Referring to FIGS. 1 and 2, a dishwasher 1 may include a main body 10. The main body 10 may form the external appearance of the dishwasher 1.

The dishwasher 1 may include a tub 12 arranged inside the main body 10. The tub 12 may be formed in a substantially box shape. One side of the tub 12 may be openable. That is, the tub 12 may include an opening portion 12*a*. As an example, a front side of the tub 12 may be openable.

The dishwasher 1 may include a door 11 provided to open or close the opening portion 12*a* of the tub 12. The door 11 may be installed in the main body 10 to open or close the opening portion 12*a* of the tub 12. The door 11 may be rotatably installed in the main body 10. The door 11 may be separably mounted to the main body 10.

The dishwasher 1 may include a water tank 18 provided to store washing water. For example, the water tank 18 may be provided between the main body 10 and the tub 12. However, it is not limited thereto, and the water tank 18 may be provided inside the tub 12 or outside the main body 10.

The dishwasher 1 may further include a storage container arranged in the tub 12 to accommodate dishware.

The storage container may include a plurality of baskets 51, 52, and 53. The plurality of baskets 51, 52, and 53 may be provided to store various dishwares. However, it is not limited thereto, and the storage container may include a single basket.

The storage container may include an intermediate basket 52 located in the middle with respect to the height direction of the dishwasher 1, and a lower basket 51 located in a lower portion with respect to the height direction of the dishwasher 1. The intermediate basket 52 may be provided to be supported by an intermediate guide rack 13*b*, and the lower basket 51 may be provided to be supported by a lower guide rack 13*a*. The intermediate guide rack 13*b* and the lower guide rack 13*a* may be installed on a side surface 12*c* of the tub 12 so as to be slidable toward the opening portion 12*a* of the tub 12. The side surface 12*c* of the tub 12 may conceptually include an inner surface of a right wall and/or an inner surface of a left wall of the tub 12.

Relatively large dishware may be stored in the plurality of baskets 5 land 52. However, the type of dishware accommodated in the plurality of baskets 51 and 52 is not limited to relatively large dishware. That is, the plurality of baskets 51 and 52 may accommodate not only relatively large dishware but also relatively small dishware.

The storage container may include an upper basket 53 located in an upper portion with respect to the height direction of the dishwasher 1. The upper basket 53 may be provided in the form of a rack assembly to accommodate relatively small dishware. For example, the upper basket 53 may accommodate a ladle, a knife, or a turner, or cutlery. In addition, the upper basket 53 may accommodate a small cup such as an espresso cup. However, the type of dishware accommodated in the upper basket 53 is not limited to the above example.

The upper basket 53 may be provided to be supported by an upper guide rack 13*c*. The upper guide rack 13*c* may be installed on the side surface 12*c* of the tub 12. For example, the upper basket 53 may be slidably moved by the upper guide rack 13*c*, and may be introduced into or withdrawn from a washing chamber C.

The dishwasher 1 may include a washing chamber C formed inside the tub 12. The washing chamber C may be defined as an inner space of the tub 12. The washing chamber C may refer to a space in which dishware placed in the storage container may be washed by washing water and dried.

The dishwasher 1 may include a spray device 40 configured to spray washing water. The spray device 40 may spray washing water into the washing chamber C. The spray device 40 may spray the washing water toward the dishware stored in the storage container. The spray device 40 may be supplied with washing water from a sump assembly 70 to be described below.

The spray device 40 may include at least one spray unit. The spray device 40 may include one spray unit or a plurality of spray units 41, 42, and 43.

For example, the plurality of spray units 41, 42, and 43 may include a first spray unit 41 arranged below the lower basket 51 in the height direction of the dishwasher 1, a second spray unit 42 arranged below the intermediate basket 52 in the height direction of the dishwasher 1, and a third spray unit 43 arranged above the upper basket 53 in the height direction of the dishwasher 1. However, it is not limited thereto, and the plurality of spray units may be provided as two spray units, or four or more spray units.

Each of the plurality of spray units 41, 42, and 43 may be provided to spray washing water while rotating. Each of the first spray unit 41, the second spray unit 42, and the third spray unit 43 may be provided to spray washing water while rotating. The plurality of spray units 41, 42 and 43 may be referred to as a plurality of spray rotors. The first spray unit 41, the second spray unit 42, and the third spray unit 43 may be referred to as a first spray rotor 41, a second spray rotor 42, and a third spray rotor 43, respectively.

However, the spray device 40 may spray washing water in a method different from the above-described example. For example, the first spray unit 41 may be fixed to one side of the lower surface 12*b* unlike the second spray unit 42 and the third spray unit 43. In this case, the first spray unite 41 may be configured to spray washing water in a substantially horizontal direction by a fixed nozzle, and the washing water sprayed in the horizontal direction from the nozzle of the first spray unit 41 may be deflected by a deflection assembly disposed in the washing chamber C so as to be directed upward. The deflection assembly may be installed on a rail (not shown) and translated along the rail. Meanwhile, although the first spray unit 41 has been described as an example, the second spray unit 42 and the third spray unit 43 may also be provided to spray washing water using fixed nozzles, similar to the above-described example.

The dishwasher 1 may include an auxiliary spray device 30. The auxiliary spray device 30 may be disposed at one side of the lower part of the washing chamber C to spray washing water to a partial area of the washing chamber C. The auxiliary spray device 30 may be designed to spray water at a relatively high-pressure compared to the spray device 40, to intensively wash heavily contaminated dishware. The auxiliary spray device 30 may be referred to as an auxiliary spray unit 30. The auxiliary spray device 30 may be omitted.

The dishwasher 1 may include a sump assembly 70. The sump assembly may be referred to as a sump 70.

The sump assembly 70 may be provided to accommodate washing water. The sump assembly 70 may collect washing water in the washing chamber C. For example, the lower surface 12*b* of the tub 12 may be provided with a downward slope toward the sump assembly 70 to smoothly collect water in the sump assembly 70. The washing water in the washing chamber C may flow along the slope of the lower surface 12*b* of the tub 12 and smoothly into the sump assembly 70.

The dishwasher 1 may include a circulation pump 500 configured to pump water stored in the sump assembly 70 toward the spray device 40. The circulation pump 500 may be provided as a component of the sump assembly 70.

The dishwasher 1 may include a drain pump 600 that drains washing water and foreign substances (e.g., food waste and the like) remaining in the sump assembly 70. The drain pump 600 may be provided as a component of the sump assembly 70.

The sump assembly 70 may pump the collected washing water to the spray device 40. The sump assembly 70 may pump the collected washing water to the auxiliary spray device 30. The sump assembly 70 may include a connection port 310 connected to the spray device 40 to supply the spray device 40 and/or the auxiliary spray device 30 with washing water. For example, the connection port 310 may be formed in a sump cover 300 (see FIG. 3) to be described below.

For example, referring to FIG. 2, the connection port 310 may include a first connection port 311 connected to the first spray unit 41, a second connection port 312 connected to the second spray unit 42, and a third connection port 313 connected to the third spray unit 43. The second connection port 312 may be connected to the second spray unit 42 through a first duct. The third connection port 313 may be connected to the third spray unit 43 through a second duct. The first duct and the second duct may be provided as separate ducts or may be provided as one duct 14 as shown in FIG. 2. The duct 14 may include a shape extending in a height direction.

For example, the connection port 310 may include a fourth connection port 314 connected to the auxiliary spray device 30. The fourth connection port 314 may be omitted depending on the presence or absence of the auxiliary spray device 30.

The dishwasher 1 may include a machine room L arranged below the tub 12. The machine room L may be a place in which components for circulating washing water may be arranged.

For example, at least some parts of the sump assembly 70 may be disposed in the machine room L. Most parts of the sump assembly 70 may be disposed in the machine room L. That is, an area of the sump assembly 70 located in the washing chamber C may be smaller than an area of the sump assembly 70 located in the machine room L. By reducing the area of the sump assembly 70 occupying the washing chamber C, the area of the washing chamber C may be secured. Accordingly, the capacity of the washing chamber C may be increased, and the storage of the dishware may be improved.

Figure 3:
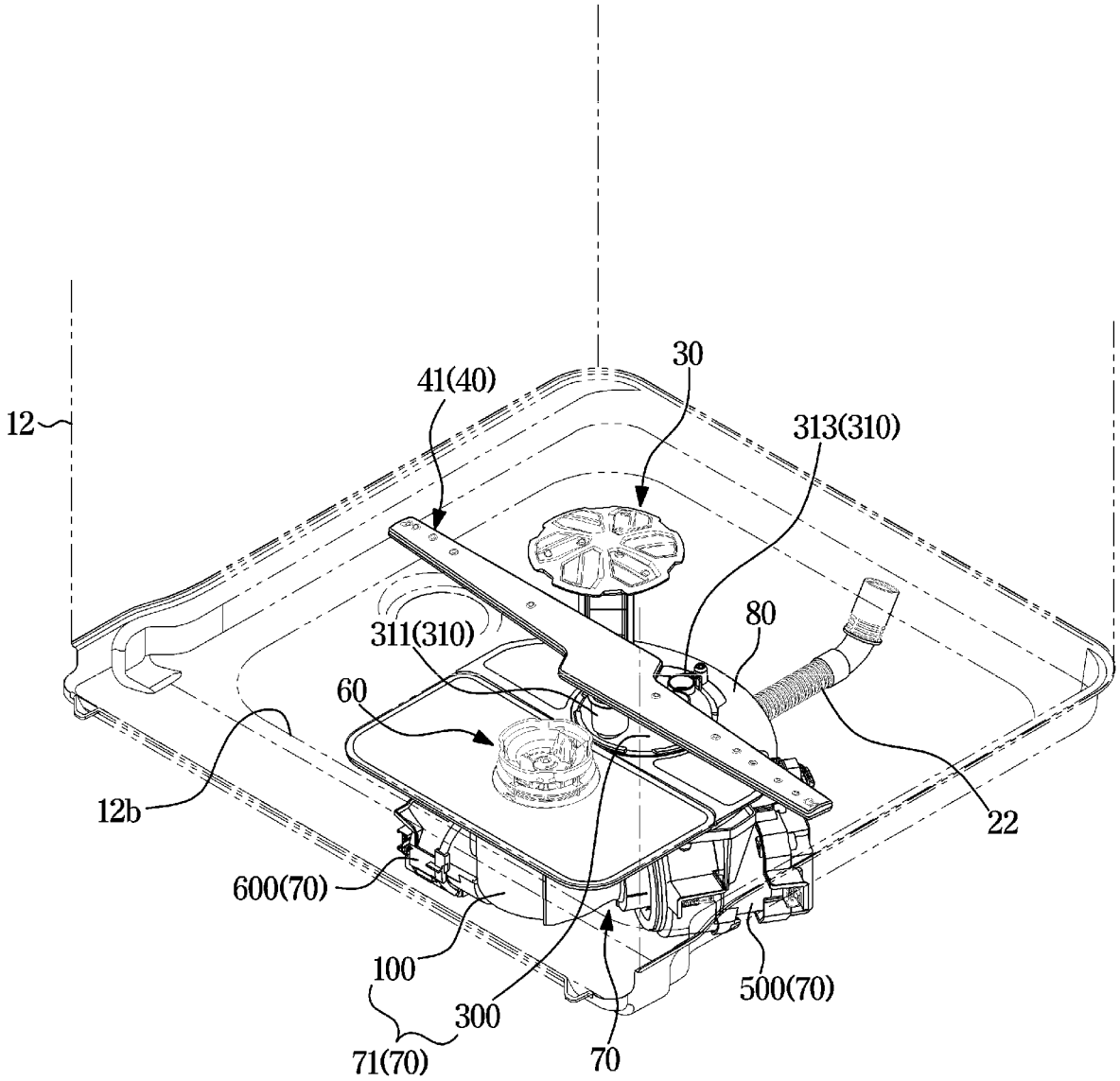
FIG. 3 is a perspective view illustrating a lower part of a dishwasher according to an embodiment.

FIG. 3 is a perspective view illustrating a lower part of a dishwasher according to an embodiment.

Referring to FIG. 3, the sump assembly 70 may include a sump body 71. The sump body 71 may form the external appearance of the sump assembly 70. Components for collecting, circulating, and supplying washing water may be attachable to or detachable from the sump body 71, thereby detachably mounted in the sump body 71.

For example, the sump body 71 may include a sump housing 100 and a sump cover 300.

The sump housing 100 may be detachably coupled to the tub 12. For example, the sump housing 100 may be screwed to the lower surface 12*b* of the tub 12. However, it is not limited thereto, and the sump housing 100 may be coupled to the tub 12 in various ways. Details thereof will be described below.

The sump cover 300 may be provided to cover the sump housing 100. The sump cover 300 may be provided to cover a portion of an upper part of the sump housing 100. The sump cover 300 may include the connection port 310. Washing water stored in the sump housing 100 may be provided to the spray device 40 through the connection port 310 of the sump cover 300.

The dishwasher 1 may include a circulation pump 500. The sump assembly 70 may include the circulation pump 500. The circulation pump 500 may pump the washing water stored in the sump housing 100 to supply the spray device 40 with the washing water. The circulation pump 500 may be coupled to the sump housing 100. The circulation pump 500 may be provided to communicate with a water storage chamber (111 in FIG. 4). The circulation pump 500 may be disposed in the machine room L.

The dishwasher 1 may include a drain pump 600. The sump assembly 70 may include the drain pump 600. The drain pump 600 may be provided to drain washing water and foreign substances stored in the sump housing 100. The drain pump 600 may be coupled to the sump housing 100. The drain pump 600 may be provided to communicate with the water storage chamber (111 in FIG. 4). The drain pump 600 may be located on the lowermost of components of the sump assembly 70 for smooth drain. The drain pump 600 may be disposed in the machine room L.

The dishwasher 1 may include a support plate 80 that may be detachably mounted on the tub 12. The support plate 80 may be provided to support at least a portion of the filter assembly 60 to be described below. Details thereof will be described below. Meanwhile, the support plate 80 may be referred to as a support cover 80 or a support frame 80.

The dishwasher 1 may include the filter assembly 60. The filter assembly 60 may be provided to filter out foreign substances included in the washing water flowing into the sump assembly 70. The filter assembly 60 may be detachably mounted on the sump housing 100. The filter assembly 60 may be disposed to correspond to the water storage chamber 111.

The filter assembly 60 may include at least one filter. For example, the filter assembly 60 may include a fine filter 61, a coarse filter 62, and a micro filter 63 (see FIG. 4).

Washing water filtered through the filter assembly 60 may be pumped by the circulation pump 500 and provided to the spray device 40. As a result, clean washing water in which foreign substances have been removed may be sprayed into the washing chamber C through the spray device 40.

Figure 4:
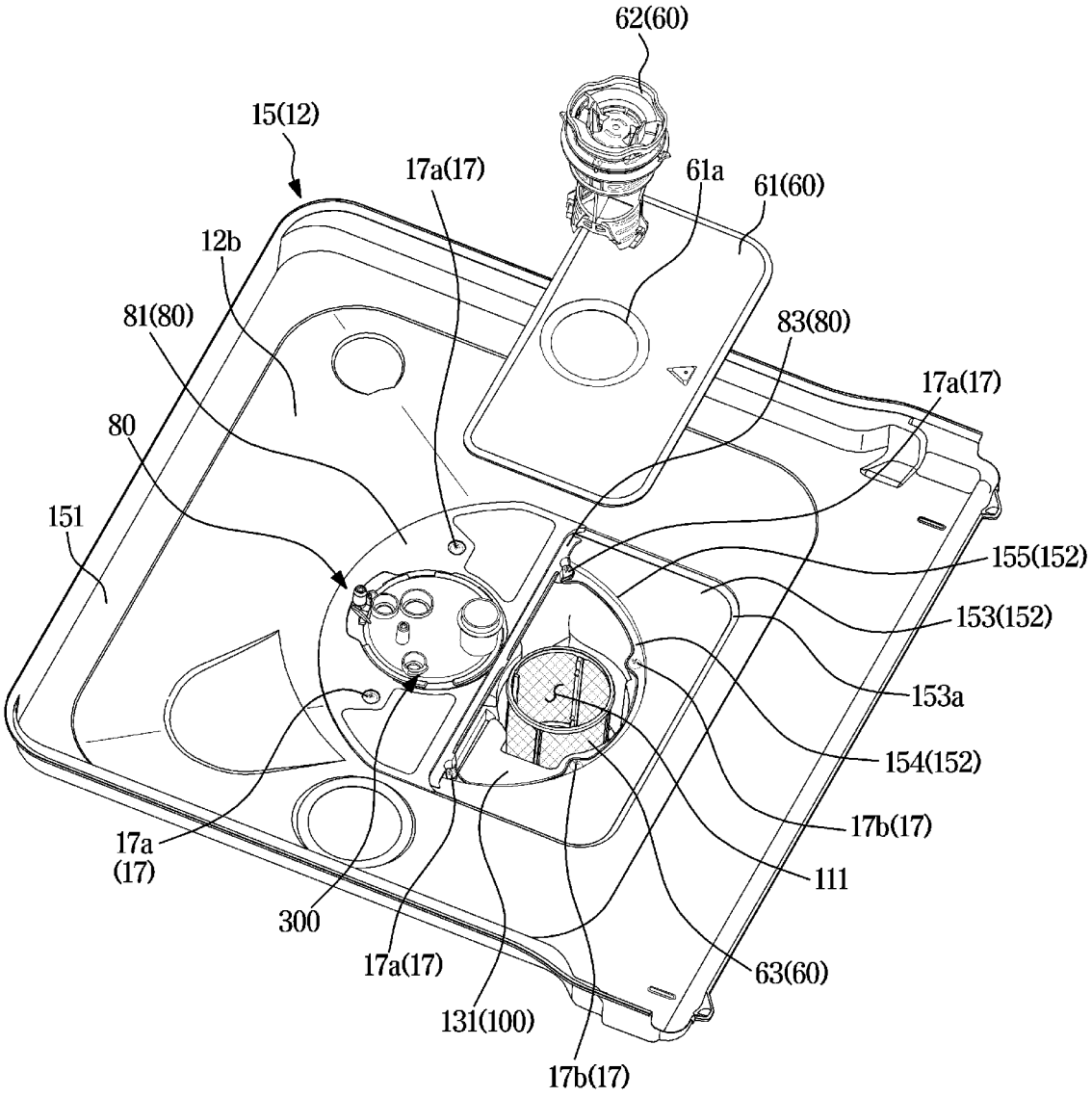
FIG. 4 is a view schematically illustrating a portion of a lower part of the dishwasher according to an embodiment.
Figure 5:
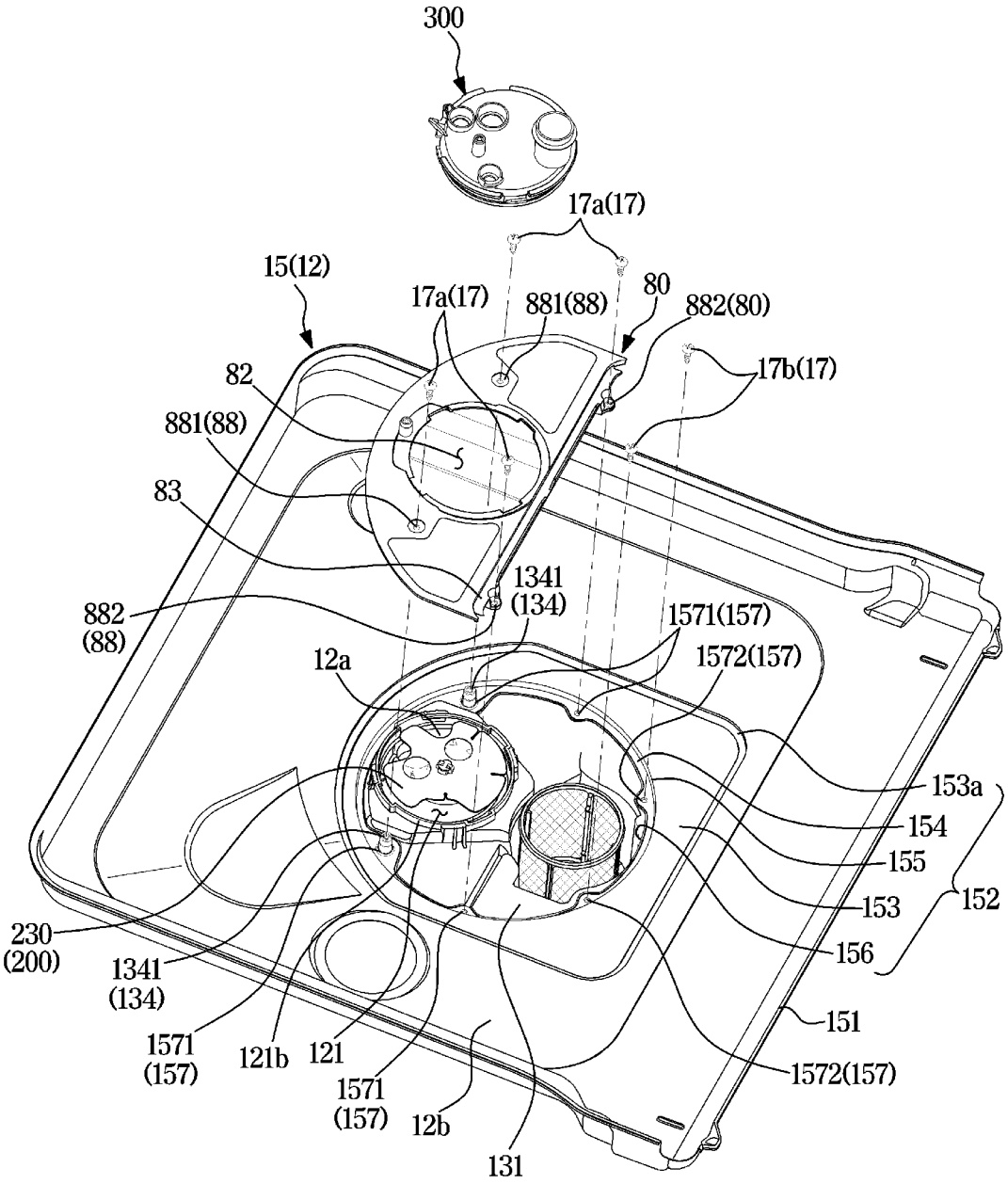
FIG. 5 is a view illustrating a portion of the lower part shown in FIG. 4, in which a portion of a filter assembly is removed and a sump cover and a support plate are dissembled.
Figure 6:
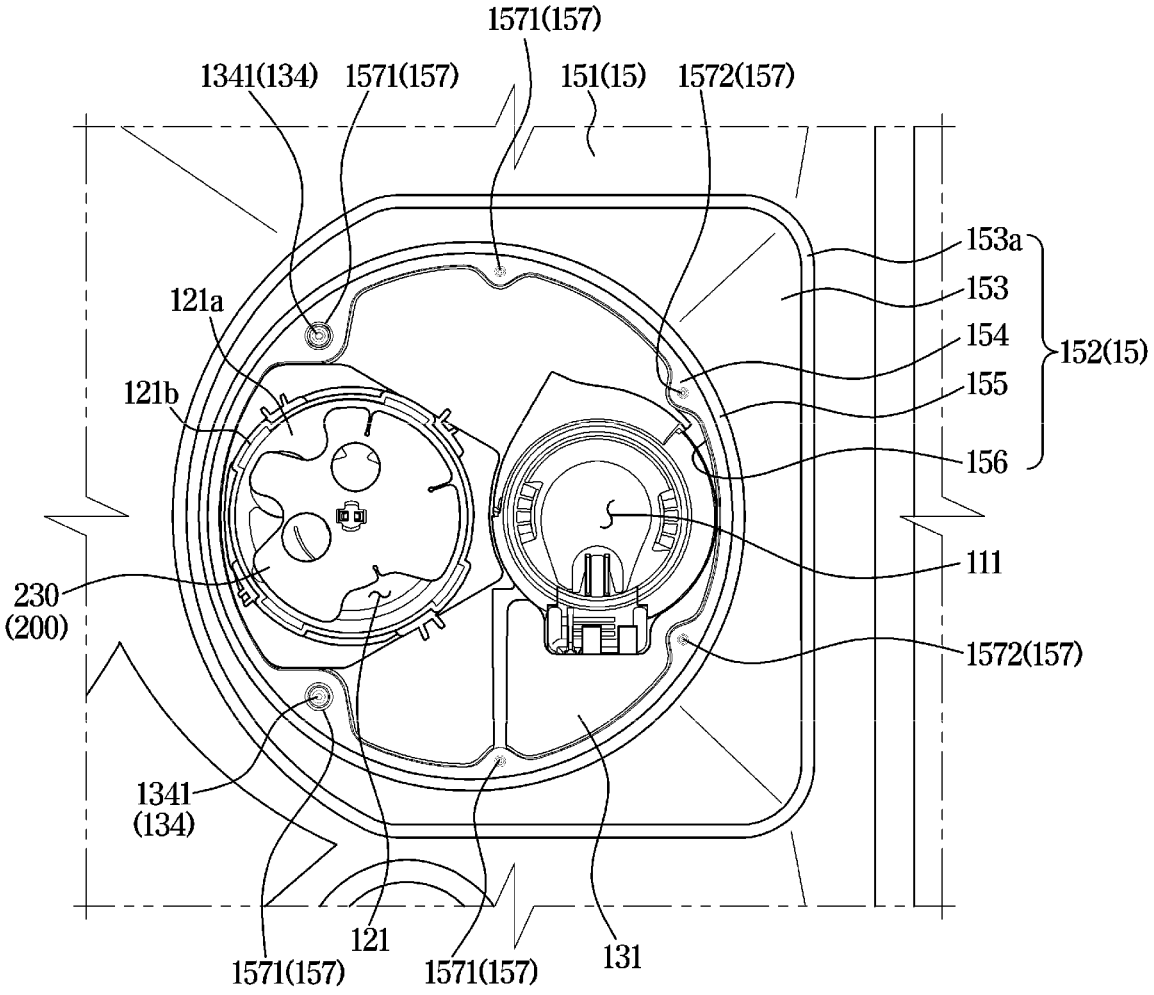
FIG. 6 is an enlarged plan view of a portion of FIG. 5.
Figure 7:
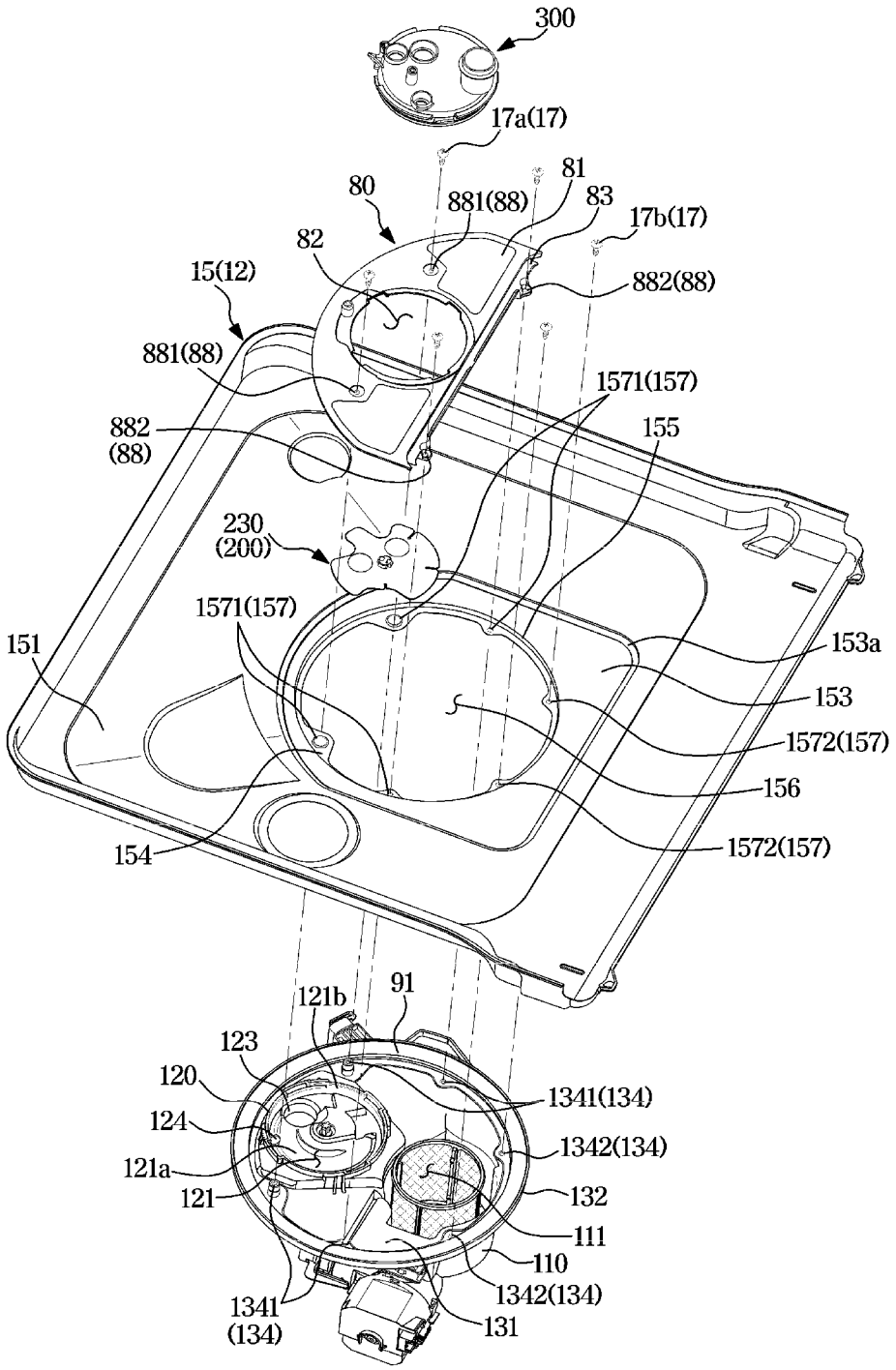
FIG. 7 is an exploded view illustrating the portion of the lower part shown in FIG. 5.

FIG. 4 is a view schematically illustrating a lower part of the dishwasher according to an embodiment. FIG. 5 is a view illustrating a portion of the lower part shown in FIG. 4, in which a filter assembly is removed and a sump cover and a support plate are dissembled. FIG. 6 is an enlarged plan view of a portion of FIG. 5. FIG. 7 is an exploded view illustrating the portion of the lower part shown in FIG. 5.

According to FIGS. 4 to 7, the tub 12 may include a lower frame 15. The lower frame 15 may form a portion of a lower part of the washing chamber C. The lower frame 15 may include the lower surface 12*b* of the tub 12. The lower surface 12*b* of the tub 12 may be referred to as a bottom 12*b* of the tub 12.

The tub 12 may include a lower body 151. The lower frame 15 may include the lower body 151. The lower body 151 may form the external appearance of the lower frame 15.

The tub 12 may include an opening flange 152. For example, the opening flange 152 may be formed on the bottom 12*b* of the tub 12. The opening flange 152 may be provided to be coupled to other components of the dishwasher 1.

For example, the lower frame 15 may include the opening flange 152. For example, the opening flange 152 may be formed on the lower body 151.

At least a portion of the sump assembly 70 may be detachably mounted on the opening flange 152. The sump housing 100 may be detachably mounted on the opening flange 152. The support plate 80 may be detachably mounted on the opening flange 152. For example, the support plate 80 may be disposed on the opening flange 152. At least a portion of the filter assembly 60 may be detachably mounted on the opening flange 152. For example, the fine filter 61 may be detachably mounted on the opening flange 152.

For example, the sump housing 100 of the sump assembly 70 may be detachably coupled to a lower side of the opening flange 152. The support plate 80 may be detachably coupled to an upper side of the opening flange 152. The fine filter 61 may be placed on the opening flange 152.

The opening flange 152 may be provided at a position corresponding to the sump assembly 70. The opening flange 152 may be provided at a substantially central portion of the lower body 151. However, it is not limited thereto, and the opening flange 152 may be provided in various positions.

The tub 12 may include a tub opening 156. For example, the opening flange 152 may form the tub opening 156. For example, the tub opening 156 may be formed in the lower surface 12*b* of the tub 12. For example, the tub opening 156 may be formed at a substantially central portion of the lower surface 12*b* of the tub 12. For example, the tub opening 156 may be provided to correspond to the sump housing 100. In a state in which the tub 12 and the sump housing 100 are coupled to each other, a water storage chamber 111 and a distribution chamber 121 of the sump housing 100, which will be described below, may be disposed inside of the edge of the tub opening 156. The tub opening 156 may be referred to as an opening 156.

In the drawings, the tub opening 156 is illustrated as having a circular shape, but is not limited thereto. The tub opening 156 may include various shapes.

For example, the opening flange 152 may include a first bottom wall 153, a second bottom wall 154, and a connection sidewall 155. The first bottom wall 153 may be formed as a recess depressed from the lower surface 12*b* of the tub 12. The second bottom wall 154 may be located downward of the first bottom wall 153 and provided to form the tub opening 156. The connection sidewall 155 may extend substantially in a vertical direction to connect the first bottom wall 153 and the second bottom wall 154 to each other. The connection sidewall 155 may be bent between the first bottom wall 153 and the second bottom wall 154. The connection sidewall 155 may include a downwardly inclined shape.

The first bottom wall 153 may be provided to surround the connection sidewall 155. The connection sidewall 155 may be provided radially inside of the first bottom wall 153, and the connection sidewall 155 may be provided to surround the second bottom wall 154. The second bottom wall 154 may be provided radially inside of the connection sidewall 155.

The opening flange 152 may include an assembly line 153*a*. The assembly line 153*a* may be provided to surround the first bottom wall 153. The assembly line 153*a* may be formed at the edge of the first bottom wall 153.

For example, the support plate 80 may be seated on the first bottom wall 153 to fit the assembly line 153*a*. As a result, the support plate 80 may be accurately seated on the opening flange 152.

For example, a part of the filter assembly 60 may be seated on the first bottom wall 153 to fit the assembly line 153*a*. For example, one side of the fine filter 61 may be seated on a seating portion 83 of the support plate 80 placed on the first bottom wall 153, and the other sides of the fine filter 61 may be seated on the first bottom wall 153 to fit the assembly line 153*a*. Thus, the filter assembly 60 may be accurately mounted on the tub 12. The fine filter 61 may be accurately seated on the opening flange 152.

The opening flange 152 may include a tub fastening portion 157. The tub fastening portion 157 may be detachably coupled to the support plate 80. The tub fastening portion 157 may be detachably coupled to the sump housing 100. For example, the tub fastening portion 157 may be formed on the second bottom wall 154.

For example, the tub fastening portion 157 may include at least one of a first tub fastening portion 1571 or a second tub fastening portion 1572. The first tub fastening portion 1571 may be detachably coupled to the support plate 80 and the sump housing 100. The second tub fastening portion 1572 may be detachably coupled to the sump housing 100. In the drawing, the tub fastening portion 157 is illustrated as a hole, but is not limited thereto and, for example, the tub fastening portion 157 may be formed as a groove.

The sump housing 100 may be disposed below the tub 12.

The sump housing 100 may include a water storage chamber 111 provided to store washing water. The water storage chamber 111 may be provided in a shape having an upper portion thereof open. The water storage chamber 111 may be provided to accommodate washing water introduced from a water supply pipe (not shown) or to accommodate washing water introduced from the tub 12.

The sump housing 100 may include a distribution chamber 121 in which washing water supplied to the spray device 40 is accommodated. The distribution chamber 121 may be divided from the water storage chamber 111. For example, the distribution chamber 121 may be formed by a chamber bottom 121*a* and a chamber sidewall 121*b*. The chamber bottom 121*a* may be surrounded by the chamber sidewall 121*b*.

The distribution chamber 121 may be supplied with washing water stored in the water storage chamber 111. Washing water accommodated in the distribution chamber 121 may be distributed to the spray device 40 through the distribution device 200.

For example, the distribution chamber 121 may be provided to accommodate at least a part of the distribution device 200. For example, the distribution chamber 121 may be provided to accommodate a distribution disk 230 of the distribution device 200.

Meanwhile, although the water storage chamber 111 and the distribution chamber 121 are illustrated as being integrally formed with each other, the disclosure is not limited thereto, and the water storage chamber 111 and the distribution chamber 121 may be provided as separate components.

The sump housing 100 may include at least one port 123 or 124 through which washing water flows in and out. The sump housing 100 may include the at least one port 123 or 124 provided to communicate with the distribution chamber 121 to allow washing water to flow therethrough. The distribution chamber 121 may include the at least one port 123 and 124. The at least one port 123 or 124 may be formed in the chamber bottom 121*a* of the distribution chamber 121.

In the following description, the ports 123 and 124 may include at least one of an inlet port 123 or an outlet port 124 to be described below. The ports 123 and 124 may include an inlet port 123. The ports 123 and 124 may include an outlet port 124. The ports 123 and 124 may include an inlet port 123 and an outlet port 124.

For example, the sump housing 100 may include a first sump body 110 provided to form the water storage chamber 111. For example, the sump housing 100 may include a second sump body 120 provided to form the distribution chamber 121. Meanwhile, unlike shown in the drawings, the first sump body 110 and the second sump body 120 may be provided as separate components.

For example, the sump housing 100 may include a third sump body 130. The third sump body 130 may refer to the external appearance of the sump housing 100 excluding the first sump body 110 and the second sump body 120.

For example, the third sump body 130 may include a base portion 131 connecting the first sump body 110 and the second sump body 120 to each other. The third sump body 130 may include a rim portion 132 protruding upward from an outer edge of the base portion 131. A sealing member 91 to be described below may be mounted on the rim portion 132.

The sump housing 100 may be detachably mounted on the opening flange 152 of the tub 12. The sump housing 100 may be aligned below the tub 12 and detachably coupled to the opening flange 152. The base portion 131 of the sump housing 100 may be detachably coupled to the opening flange 152.

The sump housing 100 may include a housing fastening portion 134. The housing fastening portion 134 may be detachably coupled to the opening flange 152 of the tub 12. The housing fastening portion 134 may be detachably coupled to the support plate 80. For example, the housing fastening portion 134 may be formed on the base portion 131.

For example, the housing fastening portion 134 may include at least one of a first housing fastening portion 1341 or a second housing fastening portion 1342. The first housing fastening portion 1341 may be detachably coupled to the support plate 80 and the sump housing 100. The second housing fastening portion 1342 may be detachably coupled to the sump housing 100. In the drawings, the housing fastening portion 134 is illustrated as a hole, but is not limited thereto, and the housing fastening portion 134 may be formed as a groove.

Meanwhile, the distribution device 200 may be provided to distribute washing water sprayed into the washing chamber C. The distribution device 200 may be provided to selectively supply washing water to a plurality of spray units. The distribution device 200 may be provided to be detachably mounted on the sump housing 100. The distribution device 200 may be provided as a component of the sump assembly 70. However, it is not limited thereto, and the distribution device may be provided as a separate component from the sump assembly 70.

For example, the distribution device 200 may include a distribution motor (not shown). The distribution device 200 may include a distribution disk 230 provided in the distribution chamber 121 to be rotated by receiving rotational force from the distribution motor. The distribution device 200 may further include a shaft (not shown) connecting the distribution motor and the distribution disk to each other. The distribution device 200 may further include a switch (not shown) provided to detect rotation of the shaft.

For example, at least a part of the distribution device 200 may be accommodated in the sump housing 100. For example, at least a part of the distribution device 200 may be housed in the distribution chamber 121. For example, the distribution disk 230 of the distribution device 200 may be accommodated in the distribution chamber 121. For example, the distribution disk 230 may be disposed in the distribution chamber 121 and provided to be rotated.

The support plate 80 may be detachably mounted on the opening flange 152 of the tub 12. The support plate 80 may be aligned above the tub 12 and detachably coupled to the opening flange 152. The support plate 80 may be seated on the opening flange 152 of the tub 12. The support plate 80 may be placed on the opening flange 152 to fit the assembly line 153*a*. The support plate 80 may be disposed in the washing chamber C.

The support plate 80 may be provided to support at least a part of the filter assembly 60. For example, the support plate 80 may include a seating portion 83. The seating portion 83 may be provided on a side adjacent to the filter assembly 60 of the support plate 80. The seating portion 83 may be provided to support one side of the fine filter 61. For example, the seating portion 83 and a portion of the assembly line 153*a* may be provided to correspond to an edge of the fine filter 61.

For example, the support plate 80 may include a plate body 81.

The plate body 81 may form the external appearance of the support plate 80.

For example, support plate 80 may include a plate opening 82.

The plate opening 82 may be formed to pass through the plate body 81. The plate opening 82 may be provided to correspond to the distribution chamber 121. The plate opening 82 may be provided to correspond to the sump cover 300.

The support plate 80 may include a plate fastening portion 88. The plate fastening portion 88 may be detachably coupled to the tub 12 and the sump housing 100. For example, the plate fastening portion 88 may include at least one of a body fastening portion 881 formed on the plate body 81 or a supporting fastening portion 882 formed on the seating portion 83. In the drawings, the plate fastening portion 88 is illustrated as a hole, but is not limited thereto, and the plate fastening portion 88 may be formed as a groove.

In the drawing, the support plate 80 is illustrated as a separate structure from the tub 12, but is not limited thereto. For example, the support plate 80 may be integrally formed with the tub 12 and provided as a component of the tub 12. In this case, for example, the seating portion 83 of the support plate 80 and the assembly line 153*a* of the opening flange 152 may form the same line.

The sump cover (the distribution cover) 300 may be provided to cover an upper portion of the distribution chamber 121. The sump cover 300 may be provided to open or close the distribution chamber 121. The sump cover 300 may be inserted into the plate opening 82 of the support plate 80 and coupled to the sump housing 100. The sump cover 300 may be inserted into the plate opening 82 of the support plate 80 and coupled to the support plate 80.

For example, the sump cover 300 may have a size corresponding to that of the distribution chamber 121. Accordingly, in a state in which the sump cover 300 is coupled to the sump housing 100, the edge of the sump cover 300 may be disposed inside of the edge of the sump housing 100. That is, the sump cover 300 may be provided in a size smaller than that of the sump housing 100, and there may be no portion of the edge of the sump cover 300 arranged outside the edge of the sump housing 100.

The sump cover 300 may be fixed to the sump housing 100 by rotating. For example, the sump cover 300 may be rotationally coupled to the distribution chamber 121. For example, the sump cover 300 may be provided to be inserted into the plate opening 82 of the support plate 80 and rotated. The sump cover 300 may be coupled to the support plate 80 via rotation. The sump cover 300 may be provided to press the support plate 80 via rotation. Accordingly, a separate fastening member (e.g., a screw, etc.) for fixing the sump cover 300 to the sump housing 100 may not be required.

Meanwhile, at least a portion of the sump cover 300 may be disposed in the washing chamber C. For example, the user may open the door 11 and separate the sump cover 300 from the sump housing 100 inside the tub 12. The user may open the door 11, and fix the sump cover 300 to the sump housing 100 inside the tub 12. That is, the user may easily separate or install the sump cover 300 without disassembling the tub 12 or opening the machine room L.

The sump cover 300 may be provided as a component of the distribution device 200 to be described below. The sump cover 300 may be referred to as a distribution cover 300.

Referring to FIGS. 4 to 7, the sump housing 100 and the tub 12 may be fastened to each other by a fastening member 17. The sump housing 100, the tub 12, and the support plate 80 may be fastened by a fastening member 17. For example, the fastening member 17 may include at least one of a first fastening member 17*a* or a second fastening member 17*b*.

For example, a first housing fastening portion 1341 of the sump housing 100, a first tub fastening portion 1571 of the tub 12, and a plate fastening portion 88 of the support plate 80 may be positioned to correspond to each other. The first housing fastening portion 1341, the first tub fastening portion 1571, and the plate fastening portion 88 may be aligned in the upper direction to lower direction. The first housing fastening portion 1341, the first tub fastening portion 1571, and the plate fastening portion 88 may overlap each other in the upper direction to lower direction. The first housing fastening portion 1341, the first tub fastening portion 1571, and the plate fastening portion 88 may be provided to be fastened to each other by the first fastening member 17*a*. For example, the first fastening member 17*a* may include a screw. However, it is not limited thereto, and may include various known coupling members.

For example, a second housing fastening portion 1342 of the sump housing 100 and a second tub fastening portion 1572 of the tub 12 may be positioned to correspond to each other. The second housing fastening portion 1342 and the second tub fastening portion 1572 may be aligned in the upper to lower direction. The second housing fastening portion 1342 and the second tub fastening portion 1572 may overlap each other in the upper to lower direction. The second housing fastening portion 1342 and the second tub fastening portion 1572 may be provided to be fastened to each other by the second fastening member 17*b*. For example, the second fastening member 17*b* may include a screw. However, it is not limited thereto, and may include various known coupling members.

For example, the fastening members 17 may be provided in plural. In a state in which the sump housing 100, the tub 12, and the support plate 80 are coupled to each other, each of the plurality of fastening members 17 may be provided to be arranged along the circumferential direction. In the drawings, although the number of fastening members 17 is shown as six, it is not limited thereto, and the number of the fastening members 17 may be less or equal to five, or more than or equal to seven. In the drawing, the number of first fastening members 17*a* is illustrated as four, but is not limited thereto, and the number of first fastening members 17*a* may be less than or equal to three or more than or equal to five. In the drawings, the number of second fastening members 17*b* is shown as two, but is not limited thereto, and the number of second fastening members 17*b* may be one, or more than or equal to three.

Meanwhile, the plurality of fastening members 17 may be provided to be spaced apart along the circumferential direction. However, as the sump assembly is miniaturized, there is a difficulty in arranging the plurality of fastening members 17 at equal intervals. In this case, non-uniform force may be applied to the tub 12 and the sump assembly 70, and the components may be displaced due to high water pressure. Accordingly, washing water may leak through a portion in which components are displaced, and foreign substances (e.g., food waste, etc.) may penetrate into the portion. As a result, the washing efficiency of the dishwasher 1 may decrease. In order to resolve the issue, the dishwasher 1 according to the disclosure may allow the sump cover 300 to hold the tub 12 in a process of being coupled to the sump housing 100. That is, in a state in which the sump cover 300 is coupled to the sump housing 100, the sump cover 300 may stably fix the tub 12. For example, the sump cover 300 may be assembled to the sump housing 100 by rotation, thereby causing the sump cover 300 to push the support plate 80 downward, and also causing the support plate 80 to press the opening flange 152 of the tub 12 downward. Details thereof will be described below.

Figure 8:
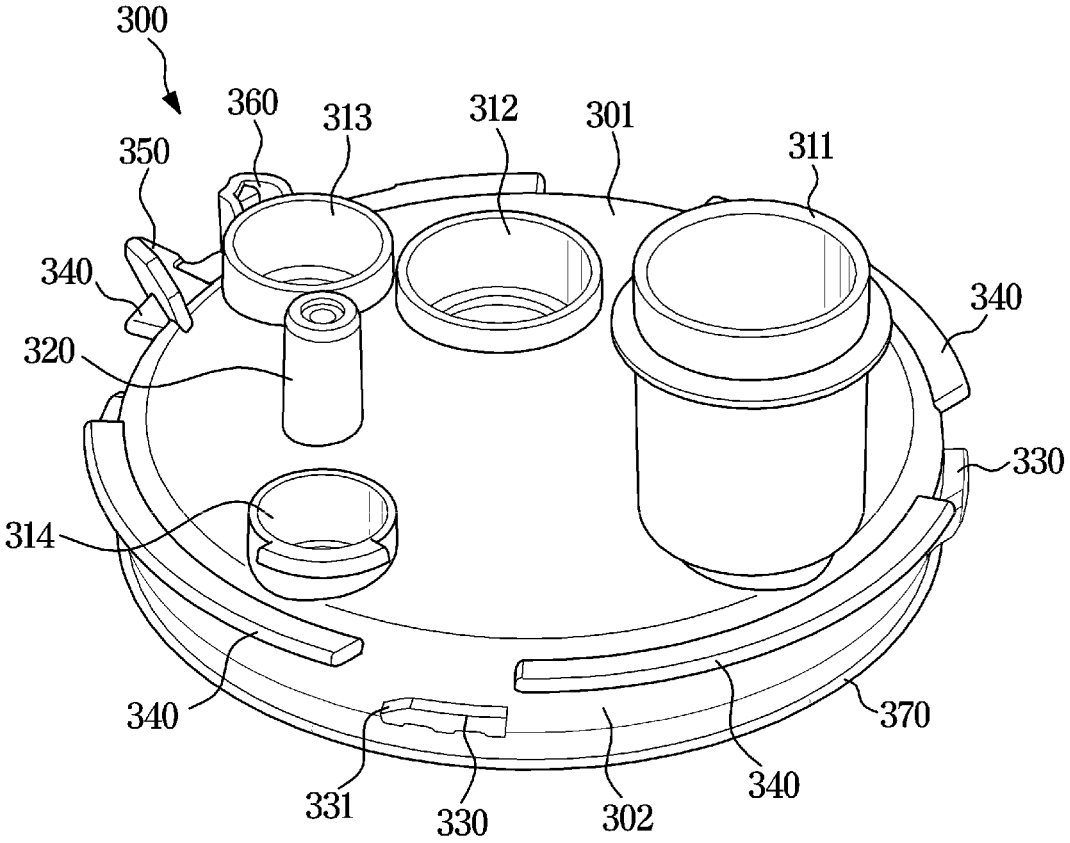
FIG. 8 is a perspective view illustrating a sump cover of a dishwasher according to an embodiment.
Figure 9:
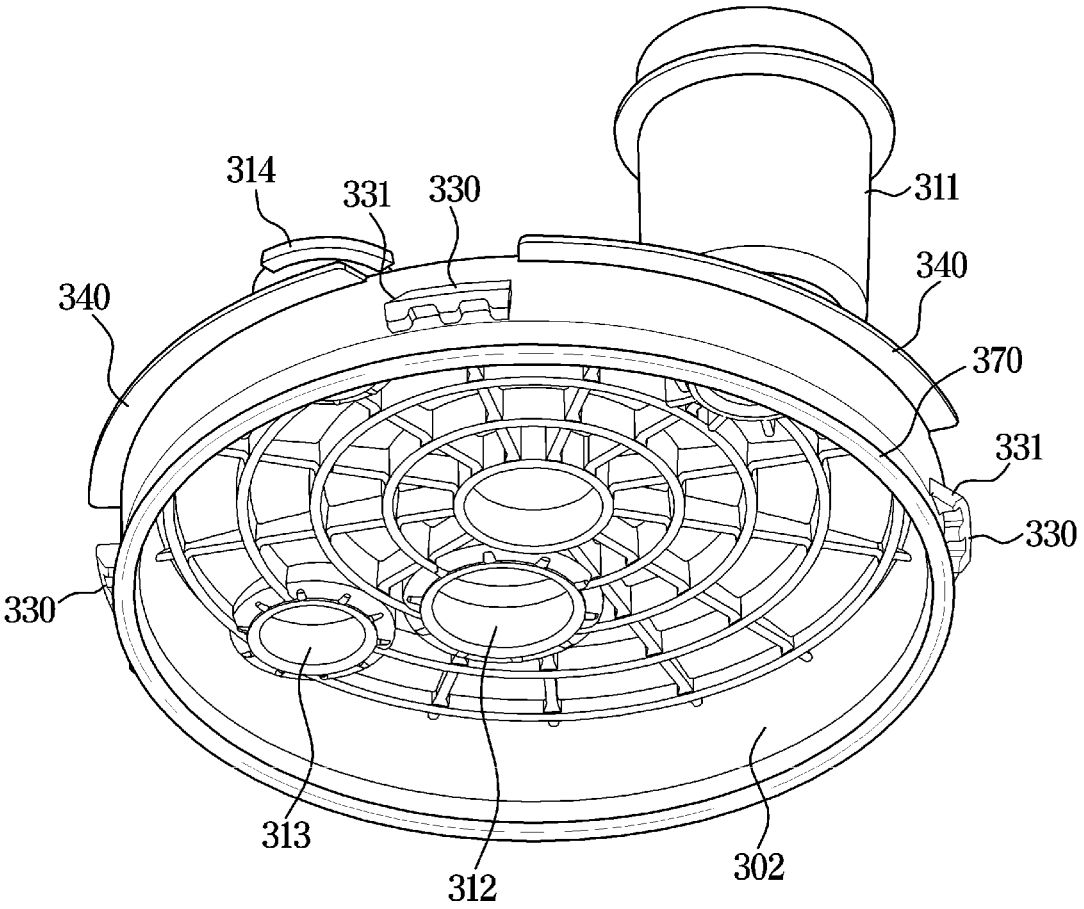
FIG. 9 is a perspective view illustrating the sump cover shown in FIG. 8 when viewed from below.

FIG. 8 is a perspective view illustrating a sump cover of a dishwasher according to an embodiment. FIG. 9 is a perspective view illustrating the sump cover shown in FIG. 8 when viewed from below.

Referring to FIGS. 8 and 9, a sump cover (a distribution cover) 300 may include a top body 301 and a cover sidewall 302.

The top body 301 may be provided to cover the upper portion of the distribution chamber 121.

A connection port 310 may be formed in the top body 301. The connection port 310 may be provided to communicate with the spray device 40. Washing water in the distribution chamber 121 may be introduced into the spray device 40 through the connection port 310. For example, the connection port 310 may be provided as a plurality of connection ports 311, 312, 313, and 314. Each of the plurality of connection ports 311, 312, 313, and 314 may be connected to a corresponding one of the plurality of spray units 41, 42, 43, and 30.

A fixing portion 320 may be formed on the top body 301. The fixing portion 320 may be provided to fix the auxiliary spray device 30.

The cover sidewall 302 may extend downward from the top body 301. For example, the cover sidewall 302 may extend downward from the edge of the top body 301. The cover sidewall 302 may be provided to correspond to the chamber sidewall 121*b* of the distribution chamber 121. The sump cover 300 may be provided to be disposed inside of the chamber sidewall 121*b* in a state in which the sump cover 300 is fixed to the sump housing 100.

The sump cover 300 may include a guide protrusion 330. The guide protrusion 330 may be formed on the cover sidewall 302. The guide protrusion 330 may protrude from the outer surface of the cover sidewall 302. The guide protrusion 330 may be provided to be coupled to the chamber sidewall 121*b*. The guide protrusion 330 may be provided to be fixed to the chamber sidewall 121*b* as the distribution cover 300 rotates. Details thereof will be described below.

For example, the guide protrusion 330 may be provided in plural. The plurality of guide protrusions 330 may be disposed to be spaced apart from each other along the circumferential direction of the sump cover 300.

The sump cover 300 may include a cover protrusion 340. The cover protrusion 340 may be provided to press the support plate 80 in a state in which the sump cover 300 is fixed to the sump housing 100. For example, the cover protrusion 340 may include a shape extending in a circumferential direction so as to press the support plate 80. For example, the cover protrusion 340 may be provided to be in contact with the upper surface of the support plate 80 in a state in which the sump cover 300 is fixed to the sump housing 100. Details thereof will be described below.

The cover protrusion 340 may be positioned above the guide protrusion 330. For example, the cover protrusion 340 may extend radially outward from the edge of the top body 301. For example, the cover protrusion 340 may extend radially outward from a region between the top body 301 and the cover sidewall 302. The cover protrusion 340 may have a shape extending along the circumferential direction of the cover sidewall 302. However, this is merely an example, and the location and/or shape of the cover protrusion 340 is not limited.

For example, the cover protrusion 340 may be provided in plural. The plurality of cover protrusions 340 may be spaced apart from each other along the circumferential direction of the sump cover 300.

The sump cover 300 may include a stopper 350. The stopper 350 may be provided to interfere with the support plate 80 by rotation of the sump cover 300. The stopper 350 may be provided to interfere with a protruding portion 89 of the support plate 80, which will to be described below, by rotation of the sump cover 300.

The sump cover 300 may include a contact rib 360. The contact rib 360 may be disposed adjacent to the stopper 350. The contact rib 360 may be provided to interfere with the support plate 80 by rotation of the sump cover 300. The contact rib 360 may be provided to be in contact with the protruding portion 89 of the support plate 80 via rotation of the sump cover 300. For example, when the contact rib 360 collides with the protruding portion 89, noise may be generated. The user may check the degree of coupling between the sump cover 300 and the sump housing 100 through the noise.

The sump cover 300 may include a sealing protrusion 370. The sealing protrusion 370 may prevent the washing water in the distribution chamber 121 from leaking out of the sump housing 100 in a state in which the sump cover 330 closes the distribution chamber 121. For example, the sealing protrusion 370 may be formed on the cover sidewall 302. The sealing protrusion 370 may be protruded from an outer surface of the cover sidewall 302 to come in contact with an inner surface of the chamber sidewall 121*b*. The sealing protrusion 370 may be formed on a lower end of the cover sidewall 302.

Figure 10:
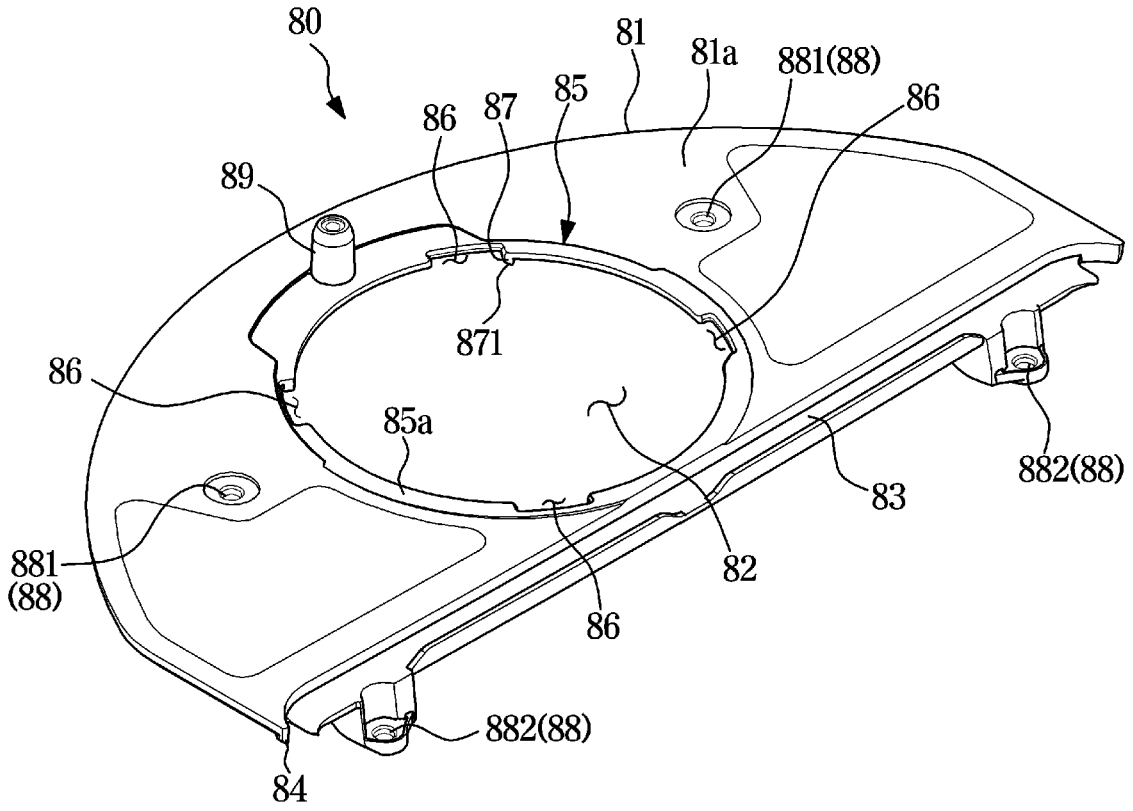
FIG. 10 is a perspective view illustrating a support plate of a dishwasher according to an embodiment.
Figure 11:
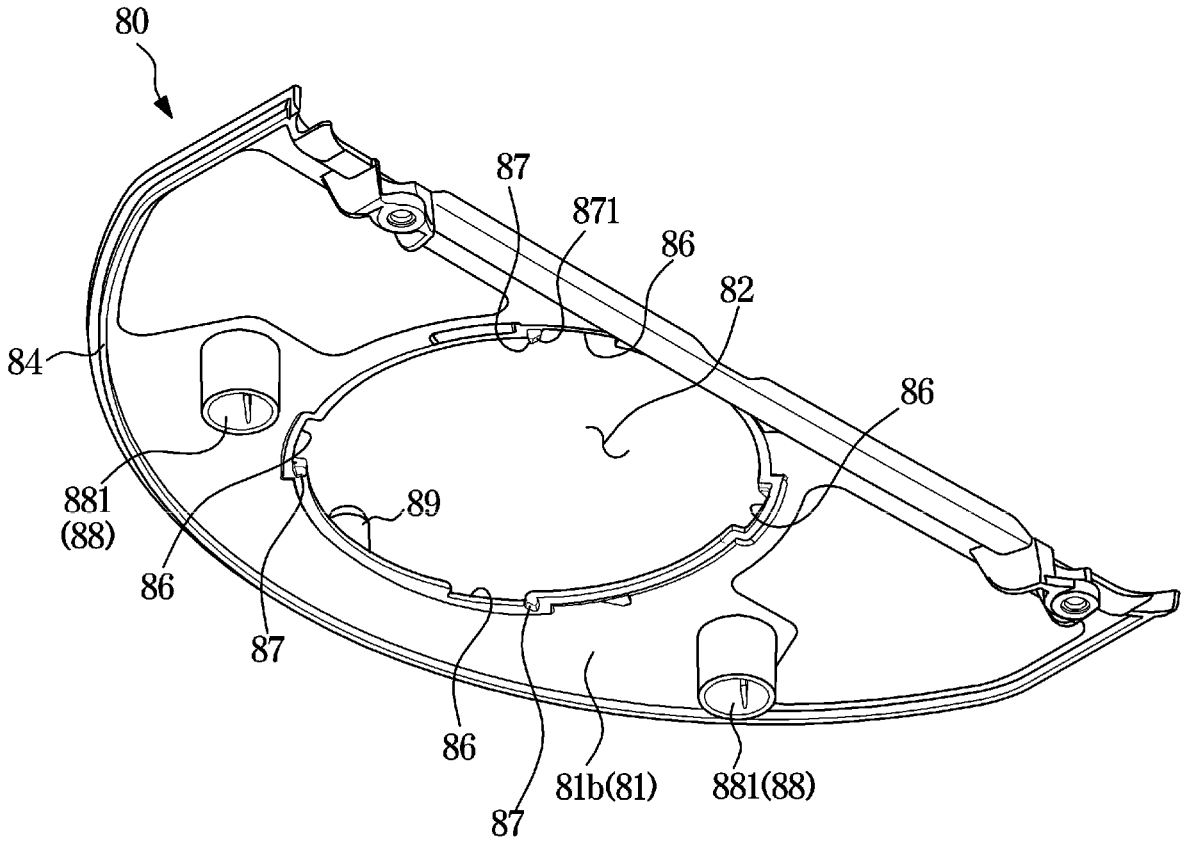
FIG. 11 is a perspective view illustrating the support plate shown in FIG. 10 when viewed from below.

FIG. 10 is a perspective view illustrating a support plate of a dishwasher according to an embodiment. FIG. 11 is a perspective view illustrating the support plate shown in FIG. 10 when viewed from below.

Referring to FIGS. 10 and 11, the support plate 80 may include a plate body 81 and a plate opening 82.

The plate body 81 may form the external appearance of the support plate 80. For example, the plate body 81 may have a substantially semicircular shape. For example, the plate body 81 may include a substantially horizontal plate shape. However, it is not limited thereto, and the plate body 81 may include various shapes.

For example, a plurality of holes (not shown) may be formed in the plate body 81. The plurality of holes formed in the plate body 81 may filter out foreign substances contained in the washing water.

The plate opening 82 may be formed to pass through the plate body 81. The plate opening 82 may be provided to correspond to the distribution chamber 121. The plate opening 82 may be provided to correspond to the cover sidewall 302 of the sump cover 300. For example, the plate opening 82 may include a circular shape. However, it is not limited thereto, and the plate opening 82 may include various shapes.

The support plate 80 may include a seating portion 83. The seating portion 83 may be provided to support one side of the fine filter 61. For example, the seating portion 83 may be formed by a recess depressed from the upper surface 81*a* of the plate body 81.

The support plate 80 may include a plate rib 84. The plate rib 84 may be provided to protrude toward the opening flange 152 of the tub 12 to press the opening flange 152 of the tub 12 in a state in which the support plate 80 is coupled to the sump housing 100 and the tub 12. The plate rib 84 may be provided to press the opening flange 152 downward in a state in which the support plate 80 is coupled to the sump housing 100 and the tub 12. For example, the plate rib 84 may extend downward from the lower surface 81*b* of the support plate 80.

For example, the plate rib 84 may extend along the edge of the plate body 81. The plate rib 84 may include a substantially half-ring shape. However, it is not limited thereto, and the plate rib 84 may include various shapes as long as it can press the opening flange 152 of the tub 12.

The support plate 80 may include a stepped portion 85. The stepped portion 85 may be provided around the plate opening 82. For example, an upper surface 85*a* of the stepped portion 85 may be positioned lower than an upper surface 81*a* of the plate body 81. For example, the upper surface 85*a* of the stepped portion 85 may be formed as a recess depressed from the upper surface 81*a* of the plate body 81.

The cover protrusion 340 of the sump cover 300 may be seated on the stepped portion 85. The stepped portion 85 may support the cover protrusion 340 of the sump cover 300. For example, the sump cover 300 may be provided to press the stepped portion 85 according to rotation of the sump cover 300. For example, the cover protrusion 340 of the sump cover 300 may be provided to press the upper surface 85*a* of the stepped portion 85 according to rotation of the sump cover 300. The cover protrusion 340 of the sump cover 300 may be provided to press the upper surface 85*a* of the stepped portion 85 downward according to rotation of the sump cover 300. For example, the stepped portion 85 may have a shape corresponding to that of the cover protrusion 340.

The stepped portion 85 may be referred to as a pressed portion 85. The stepped portion 85 may be referred to as a pressing-in portion 85.

The support plate 80 may include a counterpart groove 86. The counterpart groove 86 may be provided to correspond to an accommodation groove 125 of the distribution chamber 121 to be described below. For example, the counterpart groove 86 may be open radially outward from the plate opening 82. For example, the counterpart groove 86 may include a shape corresponding to that of the guide protrusion 330 of the sump cover 300. The guide protrusion 330 may be seated in the accommodation groove 125 by passing through the counterpart groove 86.

For example, the counterpart groove 86 may be provided in plural, and the plurality of counterpart grooves 86 may be spaced apart from each other along the circumferential direction of the plate opening 82. In the drawing, although the number of counterpart grooves 86 is shown as four, it is not limited thereto and the number of counterpart grooves 86 may be less than or equal to three, or more than or equal to five.

The support plate 80 may include a plate protrusion 87. The plate protrusion 87 may prevent the guide protrusion 330 of the distribution cover 300 from entering a region between the sump housing 100 and the support plate 80. That is, when the sump cover 300 is inserted into the plate opening 82 and rotates, the plate protrusion 87 may allow the sump cover 300 to be correctly assembled to the chamber sidewall 121*b* without entering a region between the sump housing 100 and the support plate 80. Accordingly, the assemblability of the sump housing 100 and the sump cover 300 may be improved.

The plate protrusion 87 may be disposed in the accommodation groove 125 of the distribution chamber 121 to be described below. For example, the plate protrusion 87 may protrude downward from the lower surface 81*b* of the support plate 80. For example, the plate protrusion 87 may be provided at a lower portion of the stepped portion 85. The plate protrusion 87 may be disposed adjacent to the counterpart groove 86.

The support plate 80 may include a plate fastening portion 88. For example, the plate fastening portion 88 may be coupled to the first tub fastening portion 1571 of the tub 12 and the first housing fastening portion 1341 of the sump housing 100 by the first fastening member 17*a*.

The support plate 80 may include a protruding portion 89. The protruding portion 89 may protrude upward from the support plate 80. For example, the protruding portion 89 may have a shape extending upward from the upper surface of the support plate 80. The protruding portion 89 may interfere with the stopper 350 of the sump cover 300. The protruding portion 89 may interfere with the contact rib 360 of the sump cover 300.

In the drawings, the protruding portion 89 is illustrated as being formed on the upper surface 85*a* of the stepped portion 85, but is not limited thereto. For example, the protruding portion 89 may be formed on the upper surface 81*a* of the plate body 81. The position and shape of the protruding portion 89 are not limited, as long as the protruding portion 89 can interfere with the stopper 350 and/or the contact rib 360.

For example, the protruding portion 89 may be coupled to the duct (14 in FIG. 2) by a separate fastening member. As a result, the protruding portion 89 may not be easily deformed even by force or impact applied from the outside as the protruding portion 89 is firmly fastened to the duct 14.

Figure 12:
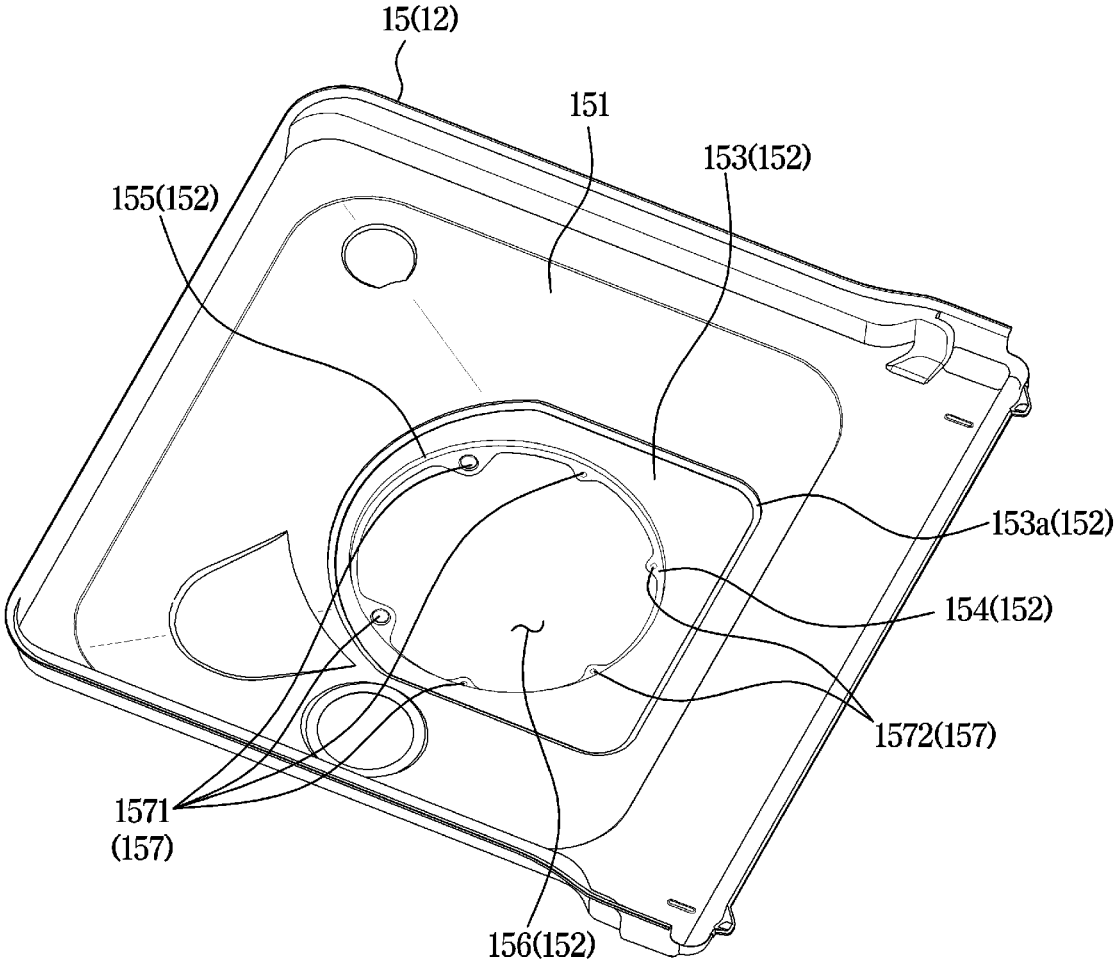
FIG. 12 is a perspective view illustrating a tub of a dishwasher according to an embodiment.

FIG. 12 is a perspective view illustrating a tub of a dishwasher according to an embodiment.

Referring to FIG. 12, the lower frame 15 of the tub 12 may include an opening flange 152.

The support plate 80 may be detachably fixed to an upper side of the opening flange 152. A portion of the filter assembly 60 may be seated on an upper side of the opening flange 152. A portion of the sump assembly 70 may be detachably fixed to a lower side of the opening flange 152. For example, the base portion 131 of the sump housing 100 may be detachably fixed to a lower side of the opening flange 152.

The opening flange 152 may form the tub opening 156. In a state in which the opening flange 152 and the sump housing 100 are coupled to each other, the water storage chamber 111 and the distribution chamber 121 of the sump housing 100 may be opened to an upper side through the tub opening 156. In a state in which the opening flange 152 and the sump housing 100 are coupled to each other, the water storage chamber 111 and the distribution chamber 121 of the sump housing 100 may be exposed to an upper side through the tub opening 156 (see FIGS. 5 and 6).

For example, as described above, the opening flange 152 may include the first bottom wall 153, the second bottom wall 154, and the connection sidewall 155.

The opening flange 152 may include the tub fastening portion 157 formed on the second bottom wall 154. For example, the first tub fastening portion 1571 may be detachably coupled to the support plate 80 and the sump housing 100. The second tub fastening portion 1572 may be detachably coupled to the sump housing 100.

Figure 13:
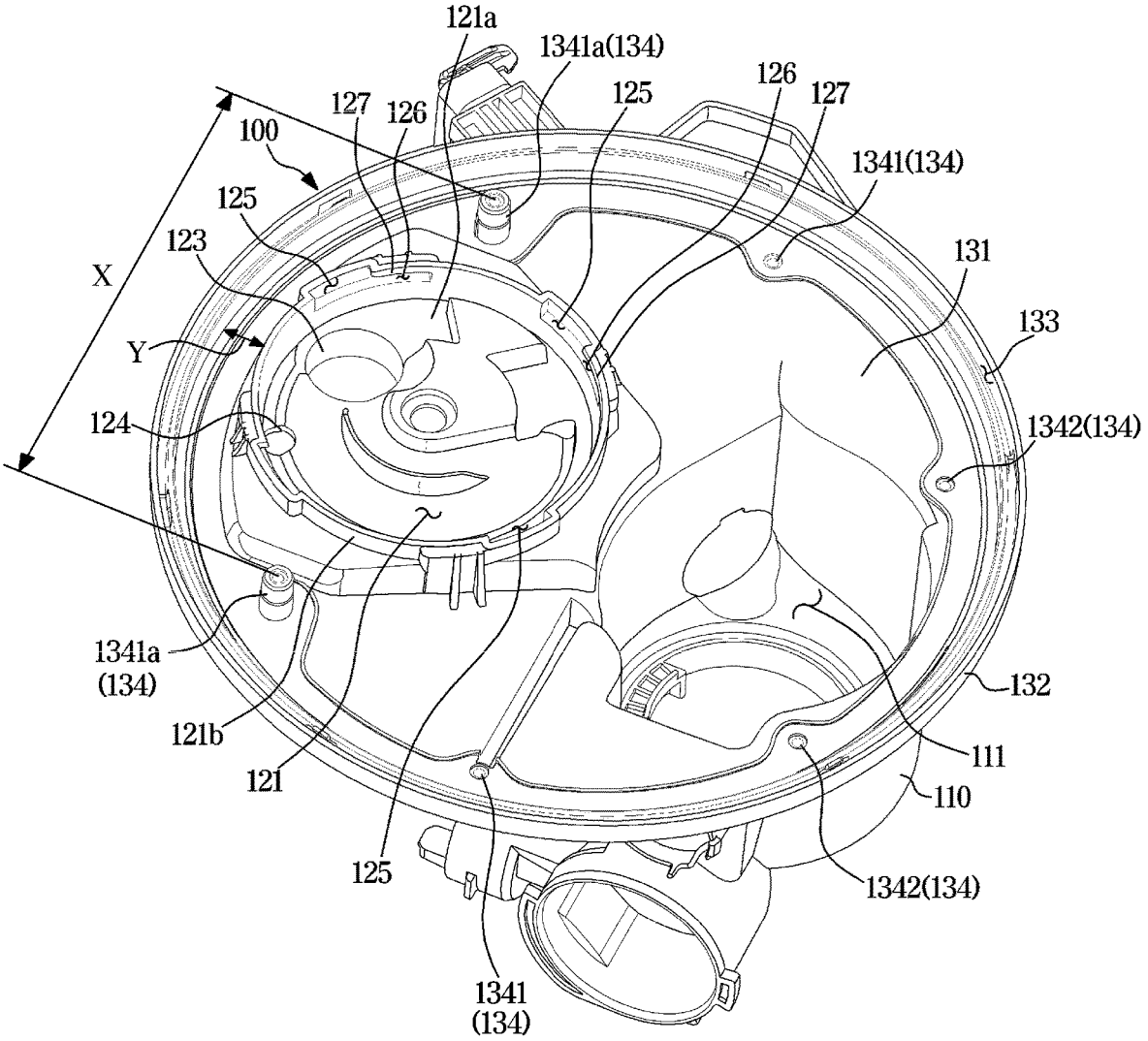
FIG. 13 is a perspective view illustrating a sump housing of a dishwasher according to one embodiment.

FIG. 13 is a perspective view illustrating a sump housing of a dishwasher according to one embodiment.

Referring to FIG. 13, the sump housing 100 may include the water storage chamber 111 provided to store washing water and the distribution chamber 121 provided to accommodate washing water that is supplied to the spray unit 40.

For example, the sump housing 100 may include the first sump body 110 provided to form the water storage chamber 111 and the second sump body 120 provided to form the distribution chamber 121. The sump housing 100 may include the third sump body 130 forming an exterior of the sump housing 100 excluding the first sump body 110 and the second sump body 120. The third sump body 130 may include the base portion 131 and the rim portion 132. For example, the rim portion 132 may include an insertion groove 133 provided to mount the sealing member 91 thereon.

The second sump body 120 may include the chamber bottom 121*a* and the chamber sidewall 121*b*. The distribution chamber 121 may be formed by the chamber bottom 121*a* and the chamber sidewall 121*b*. The distribution chamber 121 may be defined by the chamber bottom 121*a* and the chamber sidewall 121*b*.

The sump housing 100 may include the inlet port 123 through which washing water flows into the distribution chamber 121. For example, the inlet port 123 may be formed in the second sump body 120. For example, the inlet port 123 may be provided as a component of the distribution chamber 121.

The sump housing 100 may include the outlet port 124 through which washing water in the distribution chamber 121 flows out. For example, the outlet port 124 may be formed in the second sump body 120. For example, the outlet port 124 may be provided as a component of the distribution chamber 121.

The distribution chamber 121 may be located upward of the water storage chamber 111.

For example, the chamber bottom 121*a* may be located upward of the base portion 131 of the third sump body 130. The chamber bottom 121*a* may be positioned higher than the base portion 131 of the third sump body 130. For example, the chamber bottom 121*a* may be located upward of the water storage chamber 111.

For example, the chamber sidewall 121*b* may extend upward from the base portion 131 of the third sump body 130 and surround the lateral side of the chamber bottom 121*a*. The distribution chamber 121 may be located upward of the base portion 131. For example, the chamber sidewall 121*b* may extend upward further than the water storage chamber 111.

In the conventional dishwashers, a distribution chamber is provided in a shape recessed from the sump housing. Due to this, the amount of water filled in the distribution chamber may increase as much as the recessed volume of the distribution chamber. For example, since washing water in the tub may easily flow into the distribution chamber, the amount of water used by the dishwasher may increase. In addition, since the distribution chamber is located at a relatively low position, it is not easy to form an inlet port, through which washing water is introduced, at the bottom of the distribution chamber. Even when the inlet port is formed at the bottom of the distribution chamber, a pipe or hose for connecting the distribution chamber to a pump needs to be located below the distribution chamber, which increases the height of the machine room L. In consideration of this, the inlet port may be formed at the lateral side of the distribution chamber, but in this case, the flow direction of the washing water may be changed when the washing water is introduced into the distribution chamber, which may cause a pressure loss of the washing water. In addition, since the flow direction of the washing water flowing into the distribution chamber is different from the flow direction of the washing water distributed to the spray device, the washing water may not flow smoothly.

In contrast, according to an embodiment of the disclosure, the distribution chamber 121 may be provided in a shape raised from the sump housing. For example, the distribution chamber 121 may be located upward of the base portion 131. As a result, less amount of water may be filled in the distribution chamber 121. For example, washing water on the base portion 131 may be caused to flow into the water storage chamber 111 having a recessed shape without flowing into the distribution chamber 121 having a raised shape. As a result, the amount of water used by the dishwasher 1 may be reduced. In addition, even when the inlet port 123 through which the washing water is introduced is formed at the bottom of the chamber 121*a*, and a connector (e.g., a pipe or hose guiding the washing water) connected to the inlet port 123 is formed at a lower side of the distribution chamber 121, since the distribution chamber 121 is located at a relatively high position, the height of the machine room L may not increase significantly. In addition, since the inlet port 123 is formed at the chamber bottom 121*a* and communicates with the distribution chamber 121 in the vertical direction, the washing water may flow smoothly. For example, the washing water may be introduced into the distribution chamber 121 in a substantially vertical direction through the inlet port 123, and the washing water introduced into the distribution chamber 121 may be delivered to the spray device 40 in a substantially vertical direction. As a result, the pressure loss of the washing water may be reduced, and the dishwasher 1 may implement an efficient flow path system.

Meanwhile, as described above, the sump housing 100 may include the housing fastening portion 134. The housing fastening portion 134 may be formed on the base portion 131. The housing fastening portion 134 may be detachably coupled to the tub 12. The housing fastening portion 134 may be detachably coupled to the tub 12 and the support plate 80.

For example, the housing fastening portion 134 may be provided in plural. The plurality of housing fastening portions 134 may be spaced apart from each other along the circumferential direction.

In general, it is beneficial to downsize the sump assembly 70 in order to reduce the space of the machine room L while reducing the amount of water used in the dishwasher 1. For example, the sump housing 100 may be provided as an integrated type in which both the water storage chamber 111 and the distribution chamber 121 are provided. The water storage chamber 111 and the distribution chamber 121 may be provided radially inside of the outermost edge (e.g., the rim portion 132) of the sump housing 100. In this case, since the sump housing 100 is formed to be as small as possible to downsize the sump assembly 70, it may be difficult to arrange the plurality of housing fastening portions 134 at equal intervals. For example, referring to FIG. 13, in a space X between some of the plurality of housing fastening portions 134, it may be difficulty to secure a space Y of the base portion 131 for forming a separate housing fastening portion. Accordingly, it may be difficult to arrange the plurality of fastening members 17 at equal intervals. As a result, when the plurality of fastening members 17 are not spaced apart at equal intervals, non-uniform force may be applied to the tub 12 and the sump assembly 70, and some components of the dishwasher 1 may be displaced from the original positions. As a result, leakage of washing water and/or penetration of foreign substances may occur in a portion in which the components are displaced. With the dishwasher 1 according to the disclosure, the sump cover 300 may hold the tub 12 in a process of rotationally being coupled to the sump housing 100. For example, in a state in which the sump cover 300 is coupled to the sump housing 100, the sump cover 300 may press the support plate 80, and the support plate 80 may press the tub 12. That is, the dishwasher 1 according to the disclosure may have an improved structure capable of withstanding high water pressure. Accordingly, components of the dishwasher 1 may not be displaced from the original positions. As a result, leakage of washing water and/or penetration of foreign substances may be prevented and thus the washing power of the dishwasher 1 may be secured. Details thereof will be described below.

Figure 14:
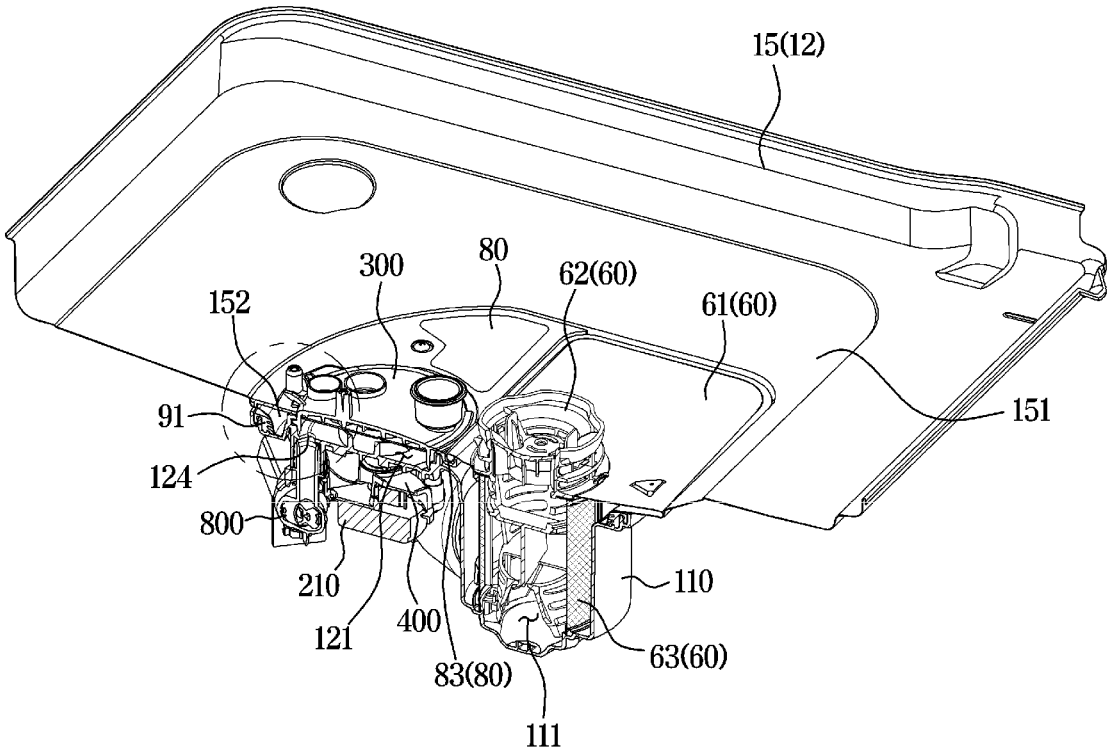
FIG. 14 is a cut-way perspective view illustrating a portion of a lower part of a dishwasher according to an embodiment taken along an example incision line.
Figure 15:
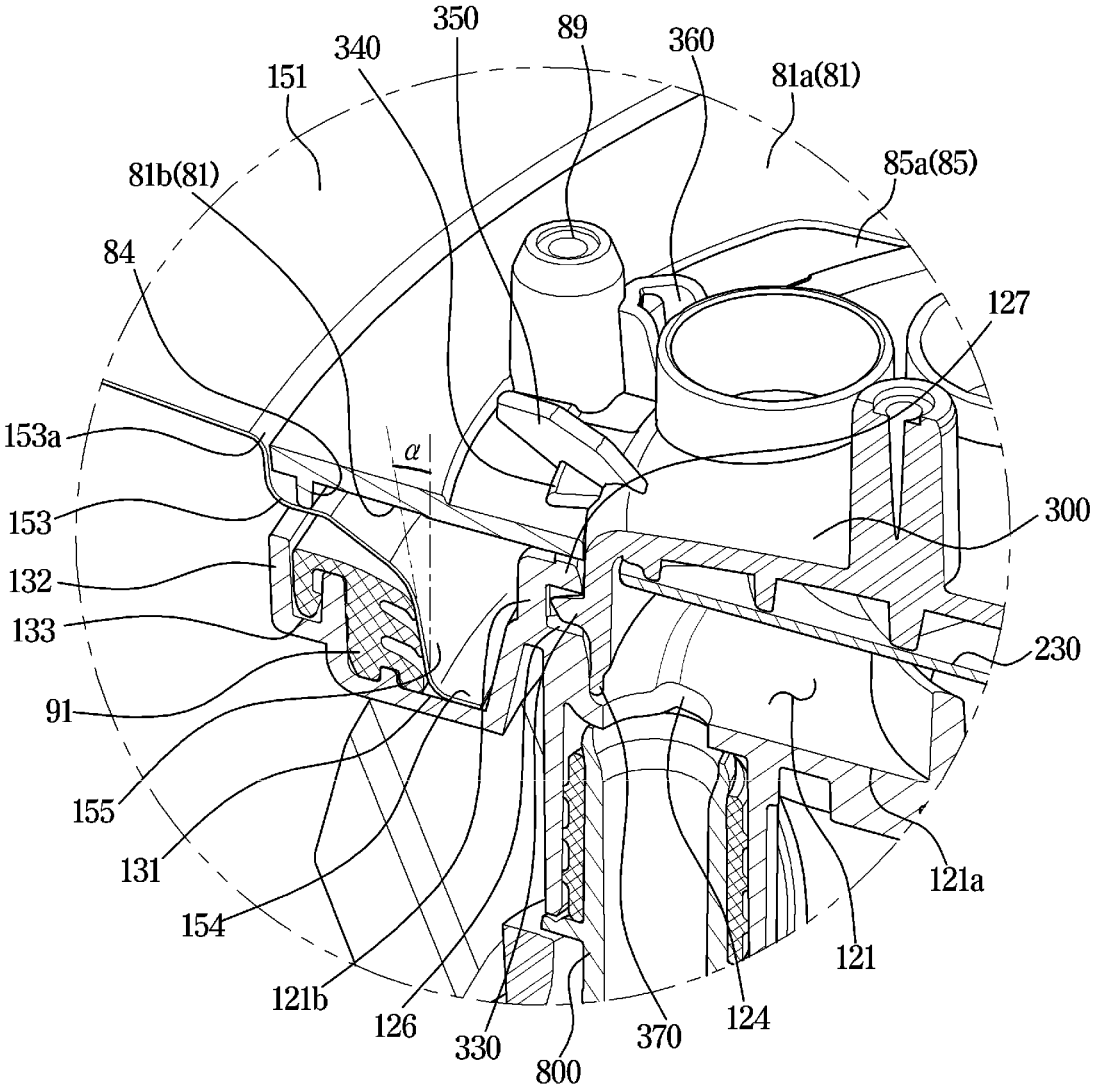
FIG. 15 is an enlarged view of the part shown in FIG. 14.

FIG. 14 is a cut-way perspective view illustrating a portion of a lower part of a dishwasher according to an embodiment taken along an example incision line. FIG. 15 is an enlarged view of the part shown in FIG. 14.

Referring to FIGS. 14 and 15, the dishwasher 1 may include a sealing member 91. The sealing member 91 may be provided to seal a region between the sump housing 100 and the tub 12.

The sealing member 91 may be detachably mounted on the sump housing 100. For example, the sealing member 91 may be disposed on the third sump body 130 of the sump housing 100. For example, at least a portion of the sealing member 91 may be inserted into the insertion groove 133.

For example, at least a portion of the sealing member 91 may be seated on the upper surface of the base portion 131.

The sealing member 91 may be disposed below the opening flange 152 of the tub 12. For example, the sealing member 91 may be disposed below the first bottom wall 153.

The sealing member 91 may be provided to press the lateral side of the opening flange 152. The sealing member 91 may be provided to press the lateral side of the connection sidewall 155 of the opening flange 152. The sealing member 91 may be disposed radially outside of the connection sidewall 155 of the opening flange 152.

As an example, since the connection sidewall 155 includes a shape inclined to have a predetermined angle $\alpha$, and the sealing member 91 seals while in friction with the lateral side of the connection sidewall 155, a force to separate the tub 12 and the sealing member 91 from each other may be generated. Accordingly, the sealing member 91 may be displaced from the original position, and furthermore, the tub 12 and the sump housing 100 may be misaligned from each other. As another example, a force to separate the sump housing 100 and the sump cover 300 from each other may be generated due to high water pressure inside the distribution chamber 121. Accordingly, the sump housing 100 and the sump cover 300 may be separated from each other in a substantially vertical direction. As another example, as the sump assembly 70 is miniaturized, it may be difficult to arrange the plurality of fastening members 17 at equal intervals, which may cause non-uniform force to be exerted on the tub 12 and the sump assembly 70, and thus some components of the dishwasher 1 may be disassembled.

In the examples described above, some components of the dishwasher 1 may displaced from the original positions or separated. In a portion in which some components of the dishwasher 1 are displaced or separated, washing water may be released, and foreign substances may be penetrated, which may cause contamination. As a result, the washing efficiency of the dishwasher 1 may decrease, and a large amount of water may be consumed in the washing operation or rinsing operation.

However, according to the disclosure, the dishwasher 1 has an improved structure, so that components of the dishwasher 1 may be prevented from being displaced from the original positions or separated. Hereinafter, an improved structure of the dishwasher 1 will be described.

The sump cover 300 may be detachably coupled to the sump housing 100 to cover the distribution chamber 121. The sump cover 300 may be fixed to the chamber sidewall 121*b* to cover the distribution chamber 121. For example, a guide protrusion 330 of the sump cover 300 may be provided to be coupled to a rail groove 126 of the chamber sidewall 121*b*, which will be described below, and caught with a catching portion 127 of the chamber sidewall 121*b* to be described below. Hereinafter, such a state may be referred to as a state in which the sump cover 300 is located at the second position P2. Details thereof will be described below.

The sump cover 300 may be provided to hold other components of the dishwasher 1 in a state in which the sump cover 300 is fixed to the sump housing 100, that is, in a state in which the sump cover 300 is located at the second position P2.

In a state in which the sump cover 300 is fixed to the sump housing 100, the sump cover 300 may press the support plate 80. For example, the cover protrusion 340 of the sump cover 300 may press the support plate 80. The cover protrusion 340 of the sump cover 300 may press the support plate 80 downward. The lower surface of the cover protrusion 340 of the sump cover 300 may be in contact with the upper surface of the support plate 80. The cover protrusion 340 of the sump cover 300 may be seated on the stepped portion 85 of the support plate 80. The lower surface of the cover protrusion 340 of the sump cover 300 may be in contact with the upper surface 85*a* of the stepped portion 85.

In a state in which the sump cover 300 is fixed to the sump housing 100, the support plate 80 may press the tub 12. The support plate 80 may press the opening flange 152 of the tub 12. The plate rib 84 of the support plate 80 may protrude toward the opening flange 152 and press the opening flange 152 of the tub 12. The plate rib 84 of the support plate 80 may press the opening flange 152 of the tub 12 downward. For example, the plate rib 84 may be seated on the first bottom wall 153. The plate rib 84 may be in contact with the first bottom wall 153. Thereby, a region between the opening flange 152 and the support plate 80 may be more reliably sealed. For example, such a configuration may prevent washing water from leaking at the assembly line 153*a* and prevent the support plate 80 from being separated from the assembly line 153*a*.

In a state in which the sump cover 300 is fixed to the sump housing 100, the catching portion 127 of the chamber sidewall 121*b*, which will be described below, may press the guide protrusion 330 of the sump cover 300. The catching portion 127 may press the guide protrusion 330 downward. For example, the catching portion 127 may be in contact with the upper surface of the guide protrusion 330.

In summary, while the sump cover 300 is being fixed to the sump housing 100, the sump cover 300 may hold the support plate 80, and the support plate 80 may hold the tub 12. While the sump cover 300 is being rotationally coupled to the sump housing 100, the sump cover 300 may press the support plate 80, and the support plate 80 may press the opening flange 152 of the tub 12. For example, as the sump cover 300 rotates, the sump cover 300 may come in contact with the support plate 80 in an approximately vertical direction. For example, as the sump cover 300 rotates, the support plate 80 may come in contact with the opening flange 152 of the tub 12 in an approximately vertical direction. In addition, the chamber sidewall 121*b* may hold the cover sidewall 302. With such a structure, displacement and/or separation of components of the dishwasher 1 may be prevented. In addition, degradation of washing power of the dishwasher 1 may be prevented.

Figure 16:
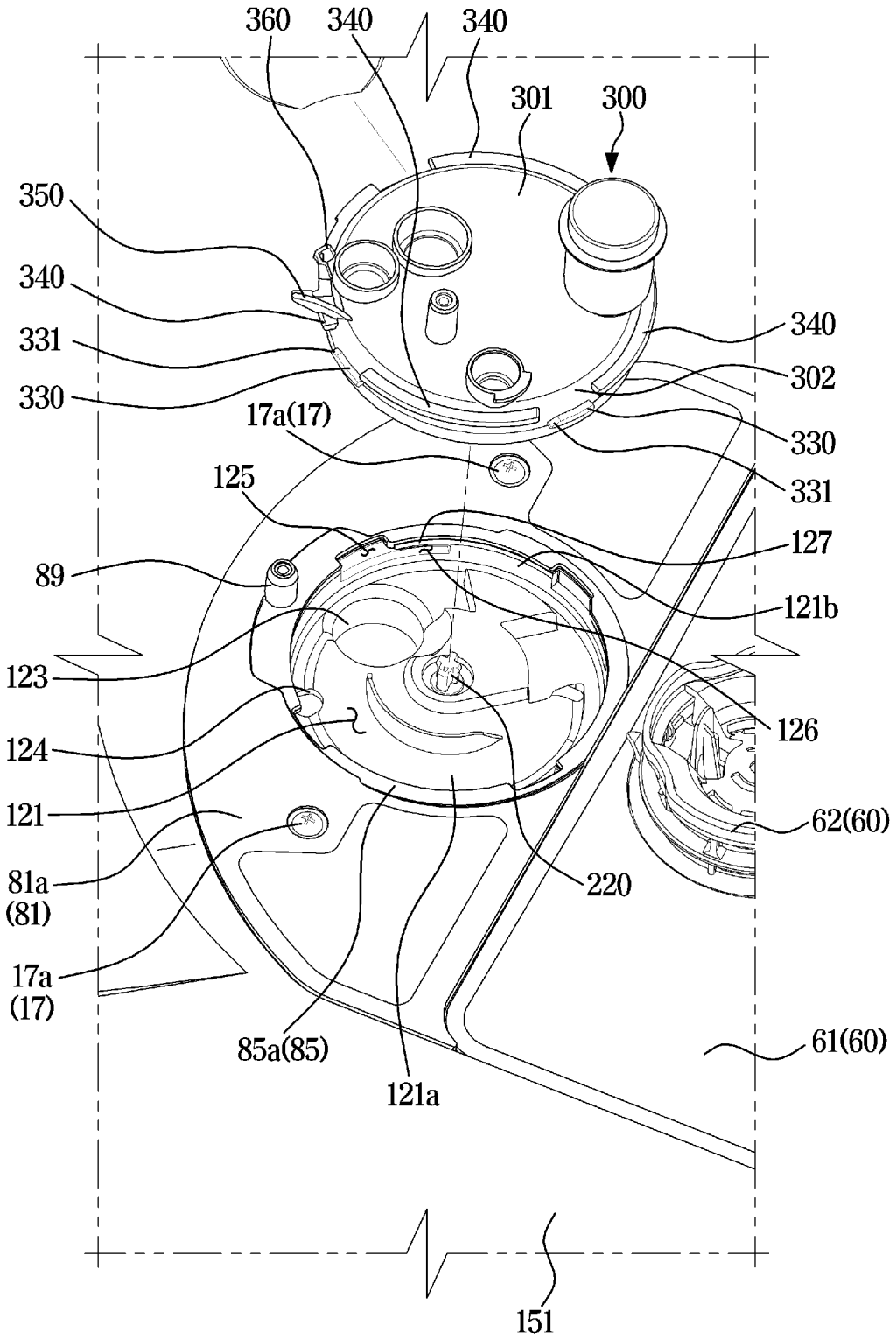
FIG. 16 is a view illustrating a state in which a sump housing and a sump cover of a dishwasher according to an embodiment are separated from each other.
Figure 17:
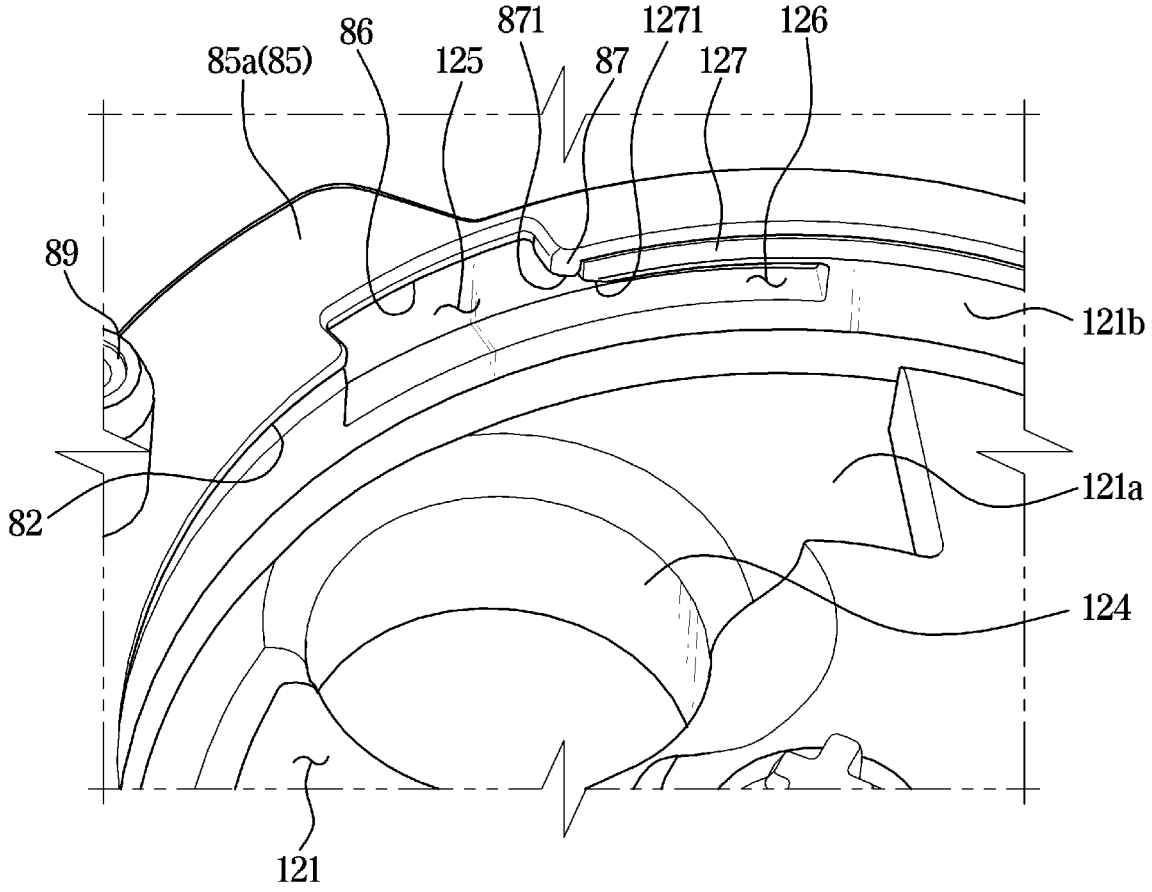
FIG. 17 is an enlarged view illustrating a portion of FIG. 16.
Figure 18:
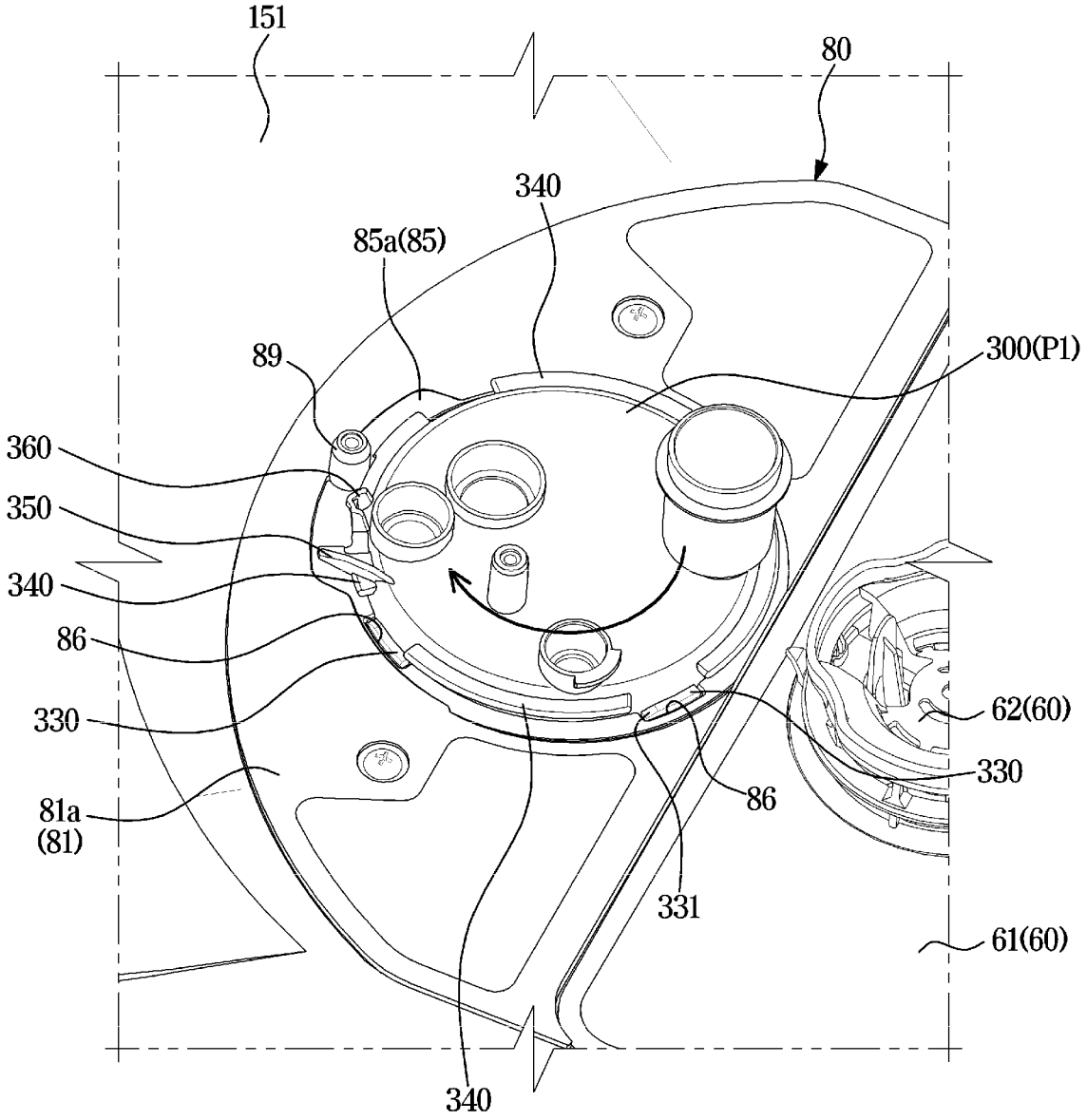
FIG. 18 is a view illustrating a state in which the sump housing and sump cover shown in FIG. 16 are coupled to be separable, that is, a state in which the sump cover is located in the first position.
Figure 19:
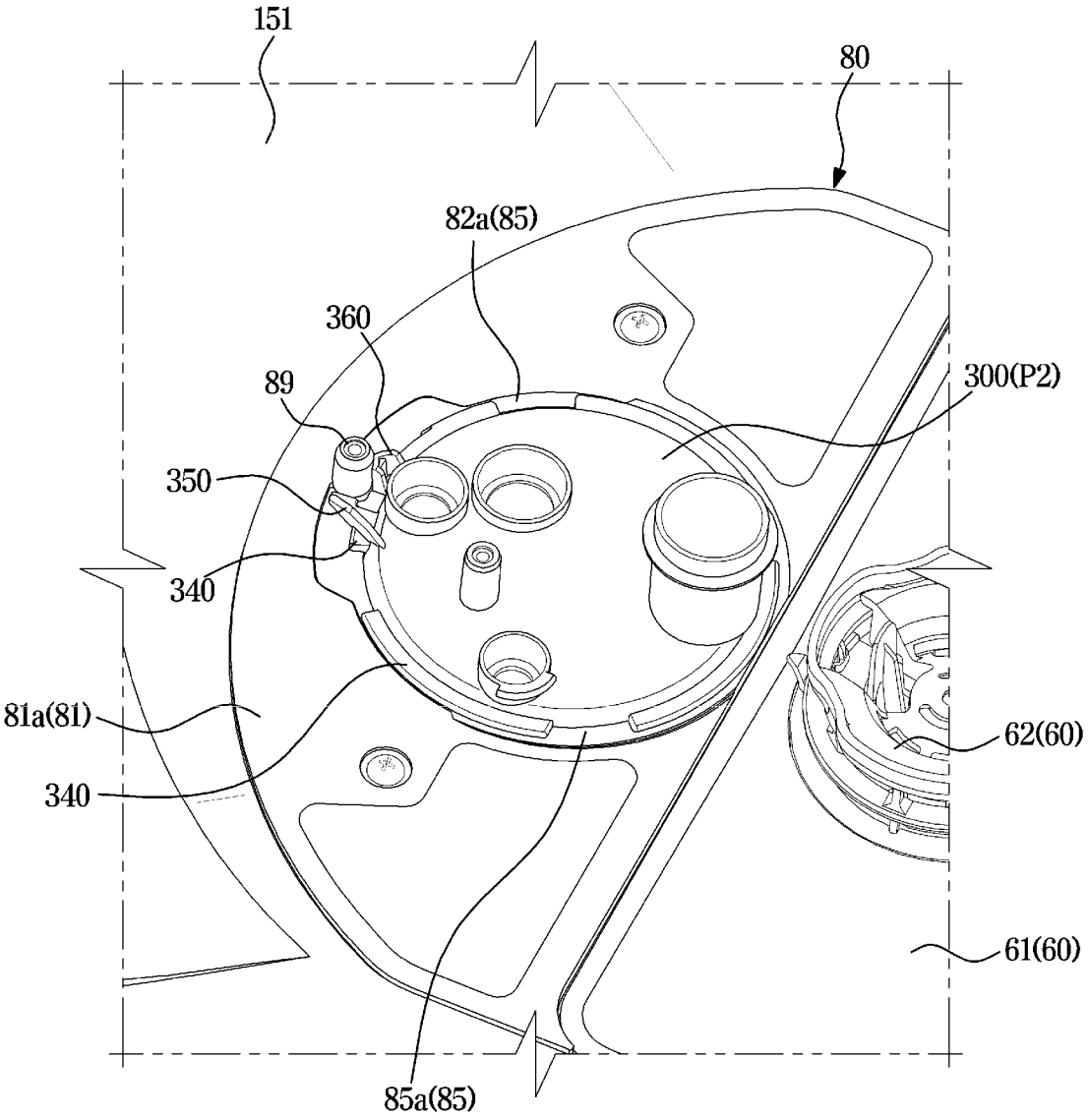
FIG. 19 is a view illustrating a state in which the sump cover shown in FIG. 18 is rotated, that is, a state in which the sump cover is located in a second position.

FIG. 16 is a view illustrating a state in which a sump housing and a sump cover of a dishwasher according to an embodiment are separated from each other. FIG. 17 is an enlarged view illustrating a portion of FIG. 16. FIG. 18 is a view illustrating a state in which the sump housing and sump cover shown in FIG. 16 are coupled to be separable, that is, a state in which the sump cover is located in the first position. FIG. 19 is a view illustrating a state in which the sump cover shown in FIG. 18 is rotated, that is, a state in which the sump cover is located in a second position. Meanwhile, for the sake of convenience of description, FIGS. 16 and 17 illustrate a state in which the distribution disk 230 is omitted.

An example of a process of the sump housing 100 and the sump cover 300 being coupled to each other will be described with reference to FIGS. 16 to 19.

Referring to FIG. 16, the sump cover 300 may be coupled to the sump housing 100 to cover an upper portion of the distribution chamber 121. The sump cover 300 may be aligned to correspond to the distribution chamber 121. For example, the cover sidewall 302 may be provided to correspond to the chamber sidewall 121*b*. The sump cover 300 may move downward to thereby be coupled to the sump housing 100.

Referring to FIGS. 16 and 17, the sump housing 100 may include a guide portion provided to guide rotation of the sump cover 300. The second sump body 120 may include the guide portion provided to guide rotation of the sump cover 300. The guide portion may be formed on the chamber sidewall 121*b*. For example, the guide portion may include an accommodation groove 125 and a rail groove 126. Meanwhile, the guide portion may be referred to as a guide rail.

The accommodation groove 125 may accommodate the guide protrusion 330 when the sump cover 300 is located at a first position P1 to be described below. The accommodation groove 125 may accommodate the guide protrusion 330 when the cover sidewall 302 of the sump cover 300 enters the distribution chamber 121. For example, the accommodation groove 125 may have a shape recessed radially outward from an inner surface of the chamber sidewall 121*b*.

The rail groove 126 may guide the guide protrusion 330 when the sump cover 300 rotates from the first position P1 to a second position P2. For example, the rail groove 126 may be formed by extending from the accommodation groove 125 in the rotational direction of the sump cover 300. The rail groove 125 may extend from a lower end portion of the accommodation groove 125 in a circumferential direction of the chamber sidewall 121*b*. The rail groove 126 may have a shape recessed radially outward from an inner surface of the chamber sidewall 121*b*.

The sump housing 100 may include a catching portion 127. The guide portion may include the catching portion 127. The catching portion 127 may be formed on the chamber sidewall 121*b*. The catching portion 127 may be provided to be caught with the guide protrusion 330 in a state in which the sump cover 300 is located at the second position P2. For example, the catching portion 127 may be located on the upper side of the rail groove 126 and provided to interfere with the guide protrusion 330 accommodated in the rail groove 126. The catching portion 127 may be provided to press the guide protrusion 330 while the sump cover 300 is located at the second position P2.

The catching portion 127 may protrude further than the rail groove 126 because the rail groove 126 is formed as a recess depressed from the inner surface of the chamber sidewall 121*b*. However, it is not limited thereto, and the catching portion 127 may protrude radially inward from the inner surface of the chamber sidewall 121*b*.

The counterpart groove 86 of the support plate 80 may be disposed to correspond to the accommodation groove 125. In a state in which the support plate is seated on the opening flange 152 of the tub 12, the counterpart groove 86 may overlap the accommodation groove 125 in the upper to lower direction.

In a state in which the support plate 80 is seated on the opening flange 152 of the tub 12, the plate protrusion 87 of the support plate 80 may be accommodated in the accommodation groove 125. The plate protrusion 87 may be disposed adjacent to the catching portion 127. For example, the plate protrusion 87 may be disposed to be in contact with the catching portion 127.

Referring to FIGS. 18 and 19, the sump cover 300 may move between the first position P1 and the second position P2. The sump cover 300 may be provided to be rotatable between the first position P1 and the second position P2. For example, the sump cover 300 may be provided to be moveable between the first position P1, in which the sump cover 300 is inserted into the distribution chamber 121, and the second position P2, in which the sump cover 300 is fixed to the distribution chamber 121 as being rotated from the first position P1. For example, when the sump cover 300 is located at the second position P2, the sump cover 300 may be prevented from being separated from the distribution chamber 121 in an approximately upper to lower direction.

Referring to FIG. 18, the sump cover 300 may be vertically coupled to the sump housing 100 to cover the distribution chamber 121. The sump cover 300 may be inserted into the plate opening 82 and rotatably coupled to the sump housing 100.

When the sump cover 300 is located at the first position P1, the sump cover 300 may be coupled to the sump housing 100 in a separable state. That is, when the sump cover 300 is located at the first position P1, the sump cover 300 may be separable from the sump housing 100 in an upward direction. For example, the guide protrusion 330 of the sump cover 300 may be in a state of being accommodated in the accommodation groove 125. The guide protrusion 330 of the sump cover 300 may be disposed in the accommodation groove 125 of the sump housing 100 by passing through the counterpart groove 86 of the support plate 80. For example, when the sump cover 300 is located at the first position P1, the guide protrusion 330 of the sump cover 300 may not be located in the rail groove 126 and may not be caught with the catching portion 127.

Referring to FIG. 19, the sump cover 300 may be located at the second position P2 by rotating from the first position P1.

When the sump cover 300 is located at the second position P2, the sump cover 300 may be fixed to the sump housing 100. That is, when the sump cover 300 is located at the second position P2, the sump cover 300 may be prevented from being separated from the sump housing 100 in the upper to lower direction. For example, as the sump cover 300 rotates from the first position P1 to the second position P2, the guide protrusion 330 accommodated in the accommodation groove 125 may move to the rail groove 126. The guide protrusion 330 may be inserted into the accommodation groove 125 and rotate along the rail groove 126. When the sump cover 300 is located at the second position P2, the guide protrusion 330 may be accommodated in the rail groove 126 and provided to interfere with the catching portion 127. That is, when the sump cover 300 is located at the second position P2, the movement of the guide protrusion 330 in the upper to lower direction may be restricted by the catching portion 127. When the sump cover 300 is located at the second position P2, the guide protrusion 330 may not be separated upward from the sump housing 100 by the catching portion 127. The catching portion 127 may apply a force to the guide protrusion 330. The catching portion 127 may press the guide protrusion 330 downward.

As a result, as the sump cover 300 is assembled to the sump housing 100 via rotation, the cover sidewall 302 of the sump cover 300 and the chamber sidewall 121*b* of the sump housing 100 may be firmly coupled to each other.

Referring to FIGS. 18 and 19, the stopper 350 of the sump cover 300 may be provided to interfere with the protruding portion 89 of the support plate 80 while the sump cover 300 is rotating from the first position P1 to the second position P2. The stopper 350 may limit rotation of the sump cover 300. The stopper 350 may prevent the sump cover 300 from further rotating from the second position P2. Thus, the sump cover 300 may be accurately located at the second position P2. In addition, the stopper 350 may prevent the guide protrusion 300 and the guide portion from being damaged due to excessive rotation of the sump cover 300.

The contact rib 360 of the sump cover 300 may be provided to interfere with the protruding portion 89 of the support plate 80 while the sump cover 300 is rotating from the first position P1 to the second position P2. The contact rib 360 may be provided to be in contact the protruding portion 89 when the sump cover 300 is located at the second position P2. The contact rib 360 may make a sound when contacting the protruding portion 89. Accordingly, the user may easily identify the degree of coupling between the sump cover 300 and the sump housing 100.

Meanwhile, when rotating from the second position P2 to the first position P1, the sump cover 300 may be rendered separable from the sump housing 100 again.

Figure 20:
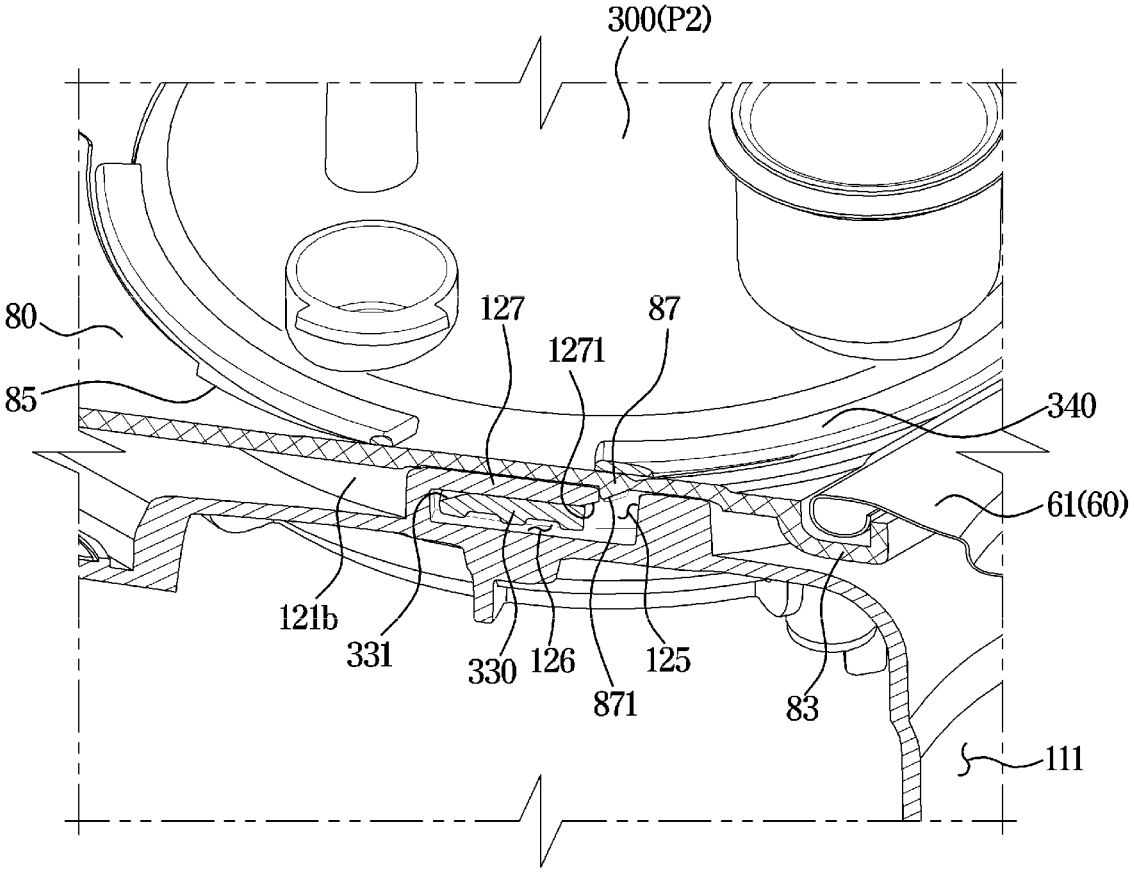
FIG. 20 is a cut-way perspective view illustrating a portion of a lower part of a dishwasher according to an embodiment taken along an example incision line when a sump cover of the dishwasher is located in a second position.

FIG. 20 is a perspective view illustrating a state in which a lower part of the dishwasher is cut along an example incision line when the sump cover of the dishwasher is in a second position according to an embodiment.

Referring to FIG. 20, the catching portion 127 of the chamber sidewall 121*b* may include an inclined surface 1271. The inclined surface 1271 may be provided between the accommodation groove 125 and the rail groove 126 and have a downwardly sloping shape. Meanwhile, the inclined surface 1271 may be referred to as a chamfer 1271.

The plate protrusion 87 of the support plate 80 may include an inclined surface 871. The inclined surface 871 may be formed at a lower portion of the plate protrusion 87. For example, the inclined surface 871 may have a shape sloping downward along the rotational direction of the sump cover 300. The inclined surface 871 may have a shape sloping downward from one side adjacent to the accommodation groove 125 to one side adjacent to the catching portion 127. Meanwhile, the inclined surface 871 may be referred to as a chamfer 871.

For example, the inclined surface 871 of the plate protrusion 87 may be provided to correspond to the inclined surface 1271 of the catching portion 127. For example, the inclined surface 871 of the plate protrusion 87 may have substantially the same inclination as that of the inclined surface 1271 of the catching portion 127. The inclined surface 871 of the plate protrusion 87 and the inclined surface 1271 of the catching portion 127 may be provided on substantially the same line. Accordingly, the guide protrusion 330 of the sump cover 300 may be easily guided from the accommodation groove 125 to the rail groove 126 along the inclined surface 871 and the inclined surface 1271. In addition, the sump cover 300 may rotate smoothly.

For example, the guide protrusion 330 may include an inclined surface 331. The inclined surface 331 of the guide protrusion 330 may have substantially the same inclination as that of the inclined surface 1271 of the catching portion 127. The inclined surface 331 of the guide protrusion 330 may have substantially the same inclination as that of the inclined surface 871 of the support plate 80. The inclined surface 331 of the guide protrusion 330 may rotate along the inclined surface 1271 of the catching portion 127 and the inclined surface 871 of the support plate 80. Thus, the guide protrusion 330 may be smoothly guided from the first position P1 to the second position P2. Meanwhile, the inclined surface 331 may be referred to as a chamfer 331.

As described above, the sump cover 300 may be rotationally coupled to the sump housing 100 in an easy manner. That is, assemblability between the sump cover 300 and the sump housing 100 may be improved.

Next, based on the above description, a method of assembling a dishwasher (the assembly sequence) will be described. Details overlapping the above descriptions may be omitted.

The tub 12, the sump housing 100, and the support plate 80 may be prepared.

The tub 12, the sump housing 100, and the support plate 80 may be aligned with each other. The tub 12, the sump housing 100, and the support plate 80 may be aligned in a substantially upper to lower direction. For example, the sump housing 100 may be aligned below the lower surface 12*b* of the tub 12, and the support plate 80 may be aligned above the bottom 12*b* of the tub 12.

The tub 12, the sump housing 100, and the support plate 80 aligned as described above may be fastened to each other. For example, the tub 12, the sump housing 100, and the support plate 80 may be fastened to each other by a fastening member 17. For example, the tub 12, the sump housing 100, and the support plate may be screwed to each other in a state in which a tub fastening portion 157, a housing fastening portion 134, and a plate fastening portion 88 are aligned with each other.

In a state in which the tub 12, the sump housing 100, and the support plate are coupled to each other, a distribution chamber 121 of the sump housing 100 may be exposed through a plate opening 82.

A sump cover 300 may be rotationally coupled to the assembly of the tub 12, the sump housing 100, and the support plate 80. The sump cover 300 may be provided to cover the distribution chamber 121 exposed through the plate opening 82. As the sump cover 300 is coupled via rotation, the sump cover 300 may press the support plate 80, and the support plate 80 may press the opening flange 152. As the sump cover 300 rotates, a guide protrusion 330 of the sump cover 300 may be provided to move along a guide portion (a guide rail) of the distribution chamber 121. As the sump cover 300 rotates from the first position P1 to the second position P2, the sump cover 300 may be fixed to the sump housing 100. Accordingly, displacement and/or separation of some components of the dishwasher 1 may be prevented.

Although certain illustrative embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A dishwasher comprising:

a tub having a washing chamber therein, the tub including:

an opening flange in a bottom of the tub, and an opening through the opening flange;

a spray device configured to spray washing water toward a dishware that is storable in the washing chamber;

a distribution device configured to distribute the washing water to the spray device;

a sump housing couplable to the opening flange of the tub, the sump housing including:

a distribution chamber configured to accommodate at least a portion of the distribution device; and a water storage chamber separated from the distribution chamber and configured to store the washing water;

a filter configured to:

filter foreign substances from the washing water that flows into the sump housing from the tub, and cover an upper portion of the water storage chamber;

a support plate on the tub, the support plate including:

a plate opening through the support plate and above the distribution chamber, and a seating portion on a side of the support plate adjacent to the filter so that one side of the filter is seated on the seating portion of the support plate; and a distribution cover that, with the sump housing coupled to the opening flange, covers an upper portion of the distribution chamber, the distribution cover insertable into the plate opening and configured so that, with the distribution cover inserted into the plate opening, pressed to the support plate, and rotated, the distribution cover is coupled to the support plate, wherein the support plate and the filter are disposed on the opening flange and extend along an edge of the opening flange, an upper side of the distribution chamber and an upper side of the water storage chamber are opened to the tub through the opening of the tub, and the opening of the tub is covered by the support plate, the filter, and the distribution cover.

2. The dishwasher of claim 1, wherein the support plate further includes a plate rib protruding toward the opening flange of the tub and configured to press the opening flange of the tub.

3. The dishwasher of claim 1, wherein in response to rotation of the distribution cover, the distribution cover contacts the support plate in a vertical direction, and the support plate contacts the opening flange of the tub in the vertical direction.

4. The dishwasher of claim 1, wherein the distribution cover is movable between:

a first position in which the distribution cover is inserted into the distribution chamber and a second position, rotated from the first position, in which the distribution cover is prevented from being separated from the distribution chamber.

5. The dishwasher of claim 4, wherein the distribution cover further includes:

a cover sidewall corresponding to a sidewall of the distribution chamber, and a guide protrusion that protrudes from an outer surface of the cover sidewall, and the sidewall of the distribution chamber further includes a guide rail configured to guide movement of the guide protrusion as the guide protrusion is moved with rotation of the distribution cover.

6. The dishwasher of claim 5, wherein the guide rail further includes:

an accommodation groove configured to accommodate the guide protrusion when the distribution cover is in the first position, and a rail groove extended from the accommodation groove in a rotation direction of the distribution cover, the rail groove configured to guide movement of the guide protrusion as the distribution cover is rotated from the first position to the second position.

7. The dishwasher of claim 6, wherein the guide rail further includes a catching portion on an upper side of the rail groove and that is configured to catch the guide protrusion with the distribution cover in the second position.

8. The dishwasher of claim 7, wherein the catching portion presses the guide protrusion with the distribution cover in the second position.

9. The dishwasher of claim 7, wherein the support plate further includes a plate protrusion that protrudes downward from the support plate and which is adjacent to the catching portion, the plate protrusion configured to prevent the guide protrusion from entering a region between the sump housing and the support plate as the guide protrusion is moved with rotation of the distribution cover.

10. The dishwasher of claim 9, wherein the catching portion further includes a first inclined surface between the accommodation groove and the rail groove, and the first inclined surface has a shape sloping downward, and the plate protrusion further includes a second inclined surface to correspond to the first inclined surface.

11. The dishwasher of claim 4, wherein the support plate further includes a protrusion protruding upward from the support plate, and the distribution cover further includes a stopper configured to interfere with the protrusion so as to limit rotation of the distribution cover as the distribution cover is rotated to the second position.

12. The dishwasher of claim 1, wherein the distribution cover further includes:

a cover sidewall corresponding to a sidewall of the distribution chamber, and a sealing protrusion that protrudes from an outer surface of the cover sidewall so as to contact an inner surface of the sidewall of the distribution chamber.

13. The dishwasher of claim 1, wherein the opening flange of the tub includes:

a first bottom wall on which the support plate is placed, a second bottom wall that is downward of the first bottom wall and that forms the opening of the tub, and a connection sidewall that connects the first bottom wall to the second bottom wall and has a shape that slopes downward.

14. The dishwasher of claim 13, further comprising:

a sealer configured to seal a region between the tub and the sump housing, the sealer at a lower side of the first bottom wall and in contact with an outer surface of the connection sidewall.

15. The dishwasher of claim 1, wherein the distribution chamber is formed by a sidewall extending upward of the water storage chamber.

* * * * *